US006272207B1

(12) United States Patent
Tang

(10) Patent No.: US 6,272,207 B1
(45) Date of Patent: Aug. 7, 2001

(54) METHOD AND APPARATUS FOR OBTAINING HIGH-RESOLUTION DIGITAL X-RAY AND GAMMA RAY IMAGES

(75) Inventor: Cha-Mei Tang, Potomac, MD (US)

(73) Assignee: Creatv MicroTech, Inc., Potomac, MD (US)

( * ) Notice: Subject to any disclaimer, the term of this patent is extended or adjusted under 35 U.S.C. 154(b) by 0 days.

(21) Appl. No.: 09/251,737

(22) Filed: Feb. 18, 1999

(51) Int. Cl.[7] ..... G21K 1/02; H05G 1/64
(52) U.S. Cl. ..... 378/149; 378/154; 378/98.8
(58) Field of Search ..... 378/145, 147, 378/148, 154, 155, 62, 988

(56) References Cited

U.S. PATENT DOCUMENTS

| | | | | |
|---|---|---|---|---|
| 4,433,427 | * | 2/1984 | Barnes | 378/149 |
| 4,688,242 | * | 8/1987 | Ema | 378/154 |
| 5,190,637 | | 3/1993 | Guckel | 205/118 |
| 5,206,983 | | 5/1993 | Guckel et al. | 29/598 |
| 5,231,654 | | 7/1993 | Kwasnick et al. | 378/147 |
| 5,378,583 | | 1/1995 | Guckel et al. | 430/325 |
| 5,379,336 | * | 1/1995 | Kramer et al. | 378/98.8 |
| 5,418,833 | | 5/1995 | Logan | 378/154 |
| 5,496,668 | | 3/1996 | Guckel et al. | 430/9 |
| 5,524,041 | * | 6/1996 | Grenier | 378/149 |
| 5,576,147 | | 11/1996 | Guckel et al. | 430/313 |
| 5,606,589 | | 2/1997 | Pellegrino et al. | 378/154 |
| 5,625,192 | * | 4/1997 | Oda et al. | 379/149 |
| 5,847,398 | * | 12/1998 | Shahar et al. | 378/149 |
| 5,949,850 | * | 9/1999 | Tang | 378/154 |
| 5,966,424 | * | 10/1999 | Liu | 378/98.8 |

OTHER PUBLICATIONS

C.M. Tang, Small Business Information Research Solicitation No. DOE/ER–0686, 21 pages (Mar. 1, 1997).*

(List continued on next page.)

*Primary Examiner*—David V. Bruce
*Assistant Examiner*—Drew A. Dunn
(74) *Attorney, Agent, or Firm*—Roylance, Abrams, Berdo & Goodman, L.L.P.

(57) ABSTRACT

An apparatus and method for obtaining a high-resolution digital image of an object or objects irradiated with radiation having a wavelength in the x-ray or gamma ray spectrum generated by a radiation source, or of an object or objects emitting radiation within the x-ray or gamma ray spectrum. The apparatus comprises a detector matrix and a radiation mask. The detector matrix comprises a plurality of detector pixels, each comprising a detection surface having a respective surface area which generates a signal in response to an energy stimulus. The radiation mask has an opaque portion, and a plurality of apertures. The aperture size and position relative to the detector array determines the image resolution not the size of the detector pixels. The mask is positioned between the detector matrix and the radiation source, such that the opaque portion prevents portions of the radiation from passing through the mask, and each of the apertures permits a portion of the radiation which has passed through or has been emitted from a respective portion of the object to propagate onto an area of the detection surface, less than the surface area, of a respective one of the detector pixels. The signal from a large detector pixel or from a group of small detector pixels represent an image of the respective portion of the object. The detector matrix and radiation mask are moved in synchronism in relation to the object to enable the areas of the detection surfaces of the detector pixels to receive portions of the radiation propagating through or emitted from other portions of the object, and to output signals representative of those other portions. These steps of moving the detector pixels and mask and irradiating the object are repeated until digital images of all portions of the object have been obtained. Alternatively, the x-ray source can be moved to image all portions of the object. The images are then arranged into an image representative of the entire object.

84 Claims, 30 Drawing Sheets

OTHER PUBLICATIONS

C.M. Tang et al., "Anti–Scattering X–Ray Grid", *Microsystem Technologies*, pp. 187–192 (1998).*
Larry E. Antonuk et al., "A Large–Area, 97 μm Pitch, Indirect–Detection, Active Matrix, Flat–Panel Imager (AMFPI)", Part of the SPIE Conference of Medical Imaging, San Diego, CA, SPIE vol. 3336, pp. 2–13, (Feb. 1998).*
Radiological Society of North America, 80$^{th}$ Scientific Assembly and Annual Meeting, Nov. 27–Dec. 2, 1994, p. 253.*
Denny L. Lee et al., "Improved Imaging Performance of a 14x17–inch Direct Radiography™ System Using Se/TFT Detector", Part of the SPIE Conference on Physics of Medical Imaging, San Diego, CA, SPIE vol. 3336, pp. 14–23 (Feb. 1998).*
Robert Street et al., "Large Area X–Ray Image Sensing Using a PbI2 Photoconductor", Part of the SPIE Conference on Physics of Medical Imaging, San Diego, CA, SPIE vol. 3336, pp. 24–32 (Feb. 1998).*
Tom J.C. Bruijns et al., "Technical and Clinical Results of an Experimental Flat Dynamic (Digital) X–ray Image Detector (FDXD) System with Real–Time Corrections", Part of the SPIE Conference on Physics of Medical Imaging, San Diego, CA, SPIE vol. 3336, pp. 33–44, (Feb. 1998).
Christophe Chaussat et al., "New CsI/a–Si 17Δx17Δ X–Ray Flat Panel Detector Provides Superior Detectivity and Immediate Direct Digital Output for General Radiography Systems", Part of the SPIE Conference on Physics of Medical Imaging, San Diego, CA, SPIE vol. 3336, pp. 45–56 (Feb. 1998).
Hans Roehrig et al., "Flat–Panel Detector, CCD Cameras and Electron Beam Tube Based Video Camera for Use in Portal Imaging", Part of the SPIE Conference on Physics of Medical Imaging, San Diego, CA, SPIE vol. 3336, pp. 163–174 (Feb. 1998).
Herbert D. Zeman et al., "Portal Imaging with a CsI(Tl) Transparent Scintillator X–Ray Detector", Part of the SPIE Conference on Physics of Medical Imaging, San Diego, CA, SPIE vol. 3336, pp. 175–186 (Feb. 1998).
Jean–Pierre Moy, "Image Quality of Scintillator Based X–ray Electronic Imagers", Part of the SPIE Conference on Physics of Medical Imaging, San Diego, CA, SPIE vol. 3336, pp. 187–194 (Feb. 1998).
G. Pang et al., "Electronic Portal Imaging Device (EPID) Based on a Novel Camera with Avalanche Multiplication", Part of the SPIE Conference on Physics of Medical Imaging, San Diego, CA, SPIE vol. 3336, pp. 195–203 (Feb. 1998).
Michael P. André et al., "An Integrated CMOS–Selenium X–Ray Detector for Digital Mammography", Part of the SPIE Conference on Physics of Medical Imaging, San Diego, CA, SPIE vol. 3336, pp. 204–209 (Feb. 1998).
Nicholas Petrick et al., "A Technique to Improve the Effective Fill Factor of Digital Mammographic Imagers", Part of the SPIE Conference on Physics of Medical Imaging, San Diego, CA, SPIE vol. 3336, pp. 210–217 (Feb. 1998).
Richard E. Colbeth et al., "Flat Panel Imaging System for Fluoroscopy Applications", Part of the SPIE Conference on Physics of Medical Imaging, San Diego, CA, SPIE vol. 3336, pp. 376–387 (Feb. 1998).
Akira Tsukamoto et al., "Development of a Selenium–Based Flat–Panel Detector for Real–Time Radiography and Fluorscopy", Part of the SPIE Conference on Physics of Medical Imaging, San Diego, CA, SPIE vol. 3336, pp. 388–395 (Feb. 1998).
N. Jung et al., "Dynamic X–Ray Imaging System Based on an Amorphous Silicon Thin–Film Array", Part of the SPIE Conference on Physics of Medical Imaging, San Diego, CA, SPIE vol. 3336, pp. 396–407 (Feb. 1998).
Dylan C. Hunt et al., "Detective Quantum Efficiency of Direct, Flat Panel X–ray Imaging Detectors for Fluoroscopy", Part of the SPIE Conference on Physics of Medical Imaging, San Diego, CA, SPIE vol. 3336, pp. 408–417 (Feb. 1998).
Cornelis H. Slump et al., "Real–Time Diagnostic Imaging with a Novel X–ray Detector with Multiple Screen—CCD Sensors", Part of the SPIE Conference on Physics of Medical Imaging, San Diego, CA, SPIE vol. 3336, pp. 418–429 (Feb. 1998).
Edmund L. Baker et al., "A physical Image Quality Evaluation of a CCD–Based X–ray Image Intensifier Digital Fluorography System for Cardiac Applications", Part of the SPIE Conference on Physics of Medical Imaging, San Diego, CA, SPIE vol. 3336, pp. 430–441 (Feb. 1998).
Richard L. Weisfield et al., "New Amorphous–Silicon Image Sensor for X–Ray Diagnostic Medical Imaging Applications", Part of the SPIE Conference on Physics of Medical Imaging, San Diego, CA, SPIE vol. 3336, pp. 444–452 (Feb. 1998).
Toshio Kameshima et al., "Novel Large Area MIS–Type X–Ray Image Sensor for Digital Radiography", Part of the SPIE Conference on Physics of Medical Imaging, San Diego, CA, SPIE vol. 3336, pp. 453–462 (Feb. 1998).
Gary S. Shaber et al., "Clinical Evaluation of a Full Field Digital Projection Radiography Detector", Part of the SPIE Conference on Physics of Medical Imaging, San Diego, CA, SPIE vol. 3336, pp. 463–469 (Feb. 1998).
Donald R. Ouimette et al., "A New Large Area X–Ray Image Sensor", Part of the SPIE Conference on Physics of Medical Imaging, San Diego, CA, SPIE vol. 3336, pp. 470–476 (Feb. 1998).
David P. Trauernicht and John Yorkston, "Screen Design for Flat–Panel Imagers in Diagnostic Radiology", Part of the SPIE Conference on Physics of Medical Imaging, San Diego, CA, pp. 477–485 (Feb. 1998).
John Rowlands and Safa Kasap, "Amorphous Semiconductors Usher in Digital X–Ray Imaging", *Physics Today*, pp. 24–30 (Nov. 1997).
N.M. Allinson, "Development of Non–Intensified Charge–Coupled Device Area X–Ray Detectors", *Journal of Synchrotron Radiation*, pp. 54–62 (1994).
I.M. Blevis et al., "Digital Radiology Using Amorphous Selenium and Active Matrix Flat Panel Readout: Photoconductive Gain and Gain Fluctuations", *Medical Imaging Research, Sunnybrook Science Center, University of Toronto*, 8 pages.
Justin M. Henry et al., "Noise in Hybrid Photodiode Array—CCD X–Ray Image Detectors for Digital Mammography", SPIE vol. 2708, pp. 106–115 (Feb. 1998).
"DpiX Digital X–Rays for Diagnosis and Treatment", *The Clock*, pp. 3, 5 and 19–21 (Dec. '97/Jan '98).
Russell C. Hardie et al., "Joint MAP Registration and High–Resolution Image Estimation Using a Sequence of Undersampled Images", *IFEE Transactions on Image Processing*, vol. 6 No. 12, pp. 1621–1632 (Dec. 1997).
Joseph C. Gillette et al., "Aliasing Reduction in Staring Infrared Imagers Utilizing Subpixel Techniques", *Optical Engineering*, vol. 34, No. 11, pp. 3130–3137 (Nov. 1995).

Russell C. Hardie et al., "High–Resolution Image Reconstruction from a Sequence of Rotated and Translated Frames and its Application to an Infrared Imaging System", *Optical Engineering*, vol. 37, No. 1, pp. 247–260, (Jan. 1998).
Kai M. Hock, "Effect of Oversampling in Pixel Arrays", *Optical Engineering*, vol. 34, No. 5, pp. 1281–1288 (May 1995).
Kenneth J. Barnard et al. "Effects of Image Noise on Submicroscan Interpolation", *Optical Engineering*, vol. 34, No. 11, pp. 3165–3173 (Nov. 1995).
Kenneth J. Barnard et al., "Nonmechanical Microscanning Using Optical Space–Fed Phased Arrays", *Optical Engineering*, vol. 33, No. 9, pp. 3063–3071 (Sep. 1994).
Gerald C. Holst, *Sampling, Aliasing, and Data Fidelity*, pp. 98–130 (published prior to Feb. 18, 1999).
Larry E. Antonuk et al., "Demonstration of Megavoltage and Diagnostic X–Ray Imaging with Hydrogenated Amorphous Silicon Arrays", *Am. Assoc. Phys. Med.*, vol. 19, No. 6, pp. 1455–1466 (Nov./Dec. 1992).
E.W. Becker et al., "Fabrication of Microstructures with high aspect ratios and great structural heights by syncrotron Radiation Lithography, Galvanoforming, and Plastic Molding (LIGA Process)," *Microelectronics Engineering*, vol. 4 pp. 35–56 (1986).
Dr. P. Bley, "The Liga Process for Fabrication of Three–Dimensional Microscale Structures," *Interdisciplinary Sci. Rev.*, vol. 18, pp. 267–272 (1993).
"DARPA Awards Contract for X–Ray Lithography System", *Micromachine Devices*, vol. 2, No. 3, p. 2 (1997).
R.L. Egan, "Intramammary Calcifications Without an Associated Mass in Benign and Malignant Diseases", *Radiology*, vol. 137, pp. 1–7 (1980).
H. Guckel, program and notes describing his "Invited talk at the American Vacuum Society Symposium", Philadelphia, PA, Oct. 1996.
"IBM Team Develops Ultrathick Negative Resist for MEMs Users", *Micromachine Devices*, vol. 2, No. 3, p. 1 (1997).
"X–Ray Lithography Scanners for LIGA", *Micromachine Devices*, vol. 1, No. 2, p. 8 (1996).
E.P. Muntz et al., "On the Significance of Very Small Angle Scattered Radiation to Radiographic Imaging at Low Energies", *Med. Phys.* vol. 10, pp. 819–823 (1983).
M.J. Yaffe et al., "X–Ray Detectors for Digital Radiography", *Phys. Med. Biol.*, vol. 42, pp. 1–39 (1997).
D.P. Siddons et al., "Precision Machining using Hard X–Rays", *Syncrotron Radiation News*, vol. 7, No. 2, pp. 16–18 (1994).
Computer printout of University of Wisconsin Web Site "http://mems.engr.wisc.edu/liga.html", entitled "UW–MEMS–Research–Deep X–ray Lithograpy and Electroplating" (web site information available to public prior to Jun. 19, 1987 filing date of present application).
Computer printout of University of Wisconsin Web Site "http://mems.engr.wisc.edu/pc.html" entitled "UW–MEMS–Research–Precision Engineering" (web site information available to public prior to Jun. 19, 1987 filing date of present application).
Computer printout of University of Wisconsin Web Site "http://mems.engr.wisc.edu/ ~guckel/homepage.html" (web site information available to public prior to Jun. 19, 1987 filing date of present application).

H. Guckel, "NATO Advanced Research Workshop on the Ultimate Limits of Fabrication and Measurement", Proceedings of the Royal Society (Invited Talk/Paper), pp. 1–15 (Apr. 1994).

H. Guckel et al., "Micromechanics via x–ray assisted processing", *Journal of Vacuum Science Technology*, pp. 2559–2564 (Jul./Aug. 1994).

W. Ehrfeld, "Coming to Terms with the Past and the Future", *LIGA News*, pp. 1–3 (Jan. 1995).

H. Guckel et al., "Micro Electromagnetic Actuators Based on Deep X–Ray Lithography", *MIMR '95, Sendai, Japan*, (Sep. 27–29, 1995).

H. Guckel et al., "Micromechanics for actuators via deep x–ray lithography", Proceedings of SPIE, Orlando, Florida, pp. 39–47 (Apr. 1994).

Z. Jing et al., "Imaging characteristics of plastic scintillating fiber screens for mammography", *SPIE*, vol. 2708, pp. 633–644 (Feb. 1996).

N. Nakamori et al., "Computer simulation on scatter removing characteristics by grid", *SPIE* vol. 2708, pp. 617–625 (Feb. 1996).

P. A. Tompkins et al., "Use of capillary optics as a beam intensifier for a Compton x–ray source", *Medical Physics*, vol. 21, No. 11, pp. 1777–1784 (Nov. 1994).

R. Fahrig et al., "Performance of Glass Fiber Antiscatter Devices at Mammographic Energies", *Am. Assoc. Phys. Med.*, vol. 21, No. 8, pp. 1277–1282 (Aug. 1994).

L.E. Antonuk et al., "Large Area, Flat–Panel, Amorphous Silicon Imagers", *SPIE* vol. 2432, pp. 216–227 (Jul. 1995).

H.E. Johns, OC, Ph.D., F.R.S.C., LL.D., D.Sc., F.C.C.P.M., *The Physics of Radiology*, Fourth Edition (Charles C. Thomas: Springfield, Illinois, 1983), p. 734.

Collimated Holes, Inc. Products Manual, pages entitled "Rectangular and Square Fibers/Fiber Arrays" (Apr. 1995) and "Scintillating Fiberoptic Faceplate Price List Type LKH–6" (Dec. 1995).

H. Guckel et al., "LIGA and LIGA–Like Processing with High Energy Photons", *Microsystems Technologies*, vol. 2, No. 3, pp. 153–156 (Aug. 1996).

H. Guckel et al., "Deep X–Ray Lithography for Micromechanics and Precision Engineering", *Synchrotron Radiation Instrumentation (Invited), Advanced Photon Source Argonne*, pp. 1–8 (Oct. 1995).

* cited by examiner

Motion Distances ((d1)/2) and a Suggested Motion Direction and Sequence 190
191
192

190
192
191

190
192
191

190
191
192

190
193
192
191

METHOD AND APPARATUS FOR OBTAINING HIGH-RESOLUTION DIGITAL X-RAY AND GAMMA RAY IMAGES

CROSS-REFERENCE TO RELATED APPLICATIONS

Related subject matter is disclosed in a U.S. patent application of Cha-Mei Tang entitled "A Method and Apparatus for Making Large Area Two-Dimensional Grids", Ser. No. 08/879,258, filed on Jun. 19, 1997, issued as U.S. Pat. No. 5,949,850 on Sep. 7, 1999, the entire contents of which is expressly incorporated herein by reference.

BACKGROUND OF THE INVENTION

1. Field of the Invention

The present invention relates to a method and apparatus employing detector pixels for obtaining an image having a resolution which is not directly related to the sizes of the detector pixels. More particularly, the present invention relates to a method and apparatus which obtains a series of spatially filtered high-resolution digital x-ray or gamma ray images of portions of an object or objects while minimizing image degradation due to conversion blurring and radiation scattering, and which arranges the spatially modulated images into a larger complete image of the object or objects.

2. Description of the Related Art

Various techniques currently exist and many are under development for obtaining digital x-ray and gamma ray images of an object for purposes such as x-ray diagnostics, medical radiology, non-destructive testing, and so on. Known devices include line digital detectors, which obtain images along essentially one direction, and therefore must be scanned across an object to obtain sectional images of the object which can be arranged into an image of the entire object. Also known are two-dimensional digital detectors which can obtain an image of the entire object at one time, and thus can operate faster than an apparatus which includes a line detector.

A digital x-ray imager creates a digital image by converting received x-rays, which are used to form the image, into electrical charges, and displaying the charge as a function of position. Digital x-ray detectors typically have the potential of high sensitivity and large dynamic range. Therefore, when used in medical applications, a digital x-ray detector will generally be capable of obtaining a suitable image of the patient without requiring the patient to receive a large dose of x-ray radiation.

Digital image data is also much easier to store, retrieve and transmit over communication networks, and is better suited for computer-aided diagnostics, than conventional film x-rays. Digital x-ray images can also be displayed more easily than conventional film x-rays, and provide greater image enhancement capabilities, a faster data acquisition rate, and simplified data archival over conventional film x-rays. These advantages make digital x-ray imaging apparatus more desirable than film x-ray apparatus for use in many diagnostic radiology applications, such as mammography.

The general construction and operation of digital x-ray detectors will now be described. As discussed briefly above, digital x-ray detectors collect electrical charges produced by x-rays as a function of position, where the amount of charge is directly proportional to the x-ray intensity. Two general approaches for x-ray conversion are currently under investigation for flat-panel digital x-ray detectors. These approaches are generally referred to as the indirect method and the direct method.

In the indirect method, x-rays are converted to low-energy photons by a scintillator, and the low-energy photons are then converted to electrical charges by solid-state detectors. This method is described in a publication by L. E. Antonuk et al., "Signal, Noise, and Readout Considerations in the Development of Amorphous Silicon Photodiode Arrays for Radiotheraphy and Diagnostic Imaging" *Proc. SPIE* 1443:108 (1991), the entire contents of which is incorporated by reference herein.

In the direct method, x-rays are converted to electron-hole pairs by photoconductors. An electric field applied to the photoconductor separates the electrons from the holes. This method is described in a publication by J. A. Rowlands et al. entitled "Flat Panel Detector for Digital Radiology Using Active Matrix Readout of Amorphous Selenium," *Physics of Medical Imaging SPIE* 3032: 97–108(1997), and in an article by R. Street, K. Shah, S. Ready, R. Apte, P. Bennett, M. Klugerman and Y. Dmitriyev, entitled "Large Area X-Ray Image Sensing Using a $PbI_{hd\ 2}$ Photoconductor," *Proc. SPIE* 3336: 24–32 (1998). The entire contents of both of these papers are incorporated by reference herein. Many types of photoconductors are under development by medical imaging community.

A type of flat-panel, two-dimensional, digital x-ray, imager comprises a plurality of charge-coupled devices (CCDs) on a silicon substrate. The CCDs can be easily made on the silicon substrate to have a pixel pitch smaller than 10 $\mu$m×10 $\mu$m. However, because the maximum size of silicon substrates is limited, to achieve the dimensions needed for a large-area flat-panel x-ray detector, multiple wafers have to be patched together. Some of the CCD x-ray detectors are described in the following publications: F. Takasashi, et al., "Development of a High Definition Real-Time Digital Radiography System Using a 4 Million Pixels CCD Camera", *Physics of Medical Imaging SPIE* 3032: 364–375 (1997); J. M. Henry, Martin J. Yaffe and T. O. Tumer, "Noise in Hybrid Photodiode Array—CCD X-ray Image Detectors for Digital Mammography," *Proc. SPIE* 2708: 106 (1996); and M. P. Andre, B. A. Spivey, J. Tran, P. J. Martin and C. M. Kimme-Smith, "Small-Field Image-Stitching Approach to Full-View Digital Mammography," Radiology 193, Suppl. Nov.–Dec., 253–253 (1994), the entire contents of each being incorporated by reference herein.

Alternatively, a flat-panel imager can include active matrix arrays of thin film transistors (TFTs) on a glass substrate. Because glass substrates can be large, the digital x-ray imager can, in principle, be made of a single substrate. However, it is very difficult to make a digital detector with a pixel pitch much smaller than 100 $\mu$m using substrates other than silicon wafers, as described in the following publications: L. E. Antonuk et al., "Development of Thin-Film, Flat-Panel Arrays for Diagnostic and Radiotherapy Imaging", *Proc. SPIE* 1651: 94 (1992); L. E. Antonuk et al., "Large Area, Flat-Panel, Amorphous Silicon Imagers", *Proc SPIE* 2432: 216 (1995); and L. E. Antonuk et al., "A Large-Area, 97 $\mu$m Pitch, Indirect-Detection, Active Matrix Flat-Panel Imager (AMFPI)", *SPIE Medical Imaging* 1998 *Technical Abstracts,* San Diego, 83 (1998), the entire contents of each being incorporated by reference herein.

As discussed above, digital x-ray imaging techniques represent a vast improvement over conventional film x-ray apparatus. However, digital x-ray imaging systems experience certain drawbacks with regard to image resolution.

It has been a common belief that the resolution of the digital image can be no better than the pixel pitch (pixel periodicity) of the imaging apparatus, and is rather often much worse due to various types of blurring phenomena which occur during image acquisition. However, as can be appreciated from the description of the operation of digital x-ray detectors set forth below, pixel pitch is only one of the many factors that influence the resolution of a digital image obtainable by a digital imaging apparatus.

Detectors for digital radiography are composed of discrete pixels which generally have a uniform size, shape and spacing. The "fill factor" is defined as the active portion of each detector pixel that is used for charge collection relative to pixel pitch or, in other words, the fraction of the pixel area occupied by the sensor for x-ray detection. A flat-panel imager having thin-film transistors (TFTs), for example, has a fill factor which decreases dramatically as the pixel pitch decreases. The TFTs are large compared to transistors on silicon substrates, and the various electrode lines occupy much surface area of the glass substrate. Hence, the fill factor decreases greatly as the pixel pitch decreases.

For example, the fill factor is 57% for a 127 $\mu$m pixel pitch array, and is 45% for a 97 $\mu$m pixel pitch array which performs indirect x-ray conversion and has been aggressively designed, as described in the article entitled "A Large-Area, 97 $\mu$m Pitch, Indirect-Detection, Active Matrix Flat-Panel Imager (AMFPI)" cited above.

The fill factor approaches zero as the pixel pitch decreases toward 50 $\mu$m in a detector employing indirect converters. When the fill factor is small, the sensitivity of the detector suffers greatly. Fortunately, however, the fill factor can be improved using direct x-ray converters and a vertical stacking architecture. However, such device becomes increasingly difficult to fabricate as pixel pitch decreases. Thus, development costs for such a device are very high, and it is unclear what the smallest achievable pixel pitch could be with this technique.

In addition, connecting the data and control lines from the detectors to the gate driver chips and readout amplifiers of the pixel array presents severe packaging problems. Currently, bonding of large array of leads from substrate to cable is limited to a device having no less than about an 80–100 $\mu$m pixel pitch. By increasing the pixel resolution, multiplexed contacts or new bonding techniques must be developed to create input and output terminals for the device.

The modulation transfer function (MTF), which is a function of spatial frequency f versus location on the detector, is useful for analyzing spatial resolution. Larger MTF values mean better resolution. For existing flat-panel detectors, MTFs are important in analyzing two steps of the image acquisition sequence: the detector pixel pitch, and the blurring produced during the conversion of x-rays to charges. (See, e.g., an article by J. M. Henry, Martin J. Yaffe and T. O. Tumer, "Noise in Hybrid Photodiode Array—CCD X-ray Image Detectors for Digital Mammography," *Proc. SPIE* 2708:106(1996), the entire contents of which is incorporated by reference herein).

The charges generated by x-ray conversion can become blurred spatially. The source of blurring for indirect conversion using phosphor is different from that for direct conversion. For most detectors, the measured MTF is dominated primarily by the blurring of the converter when the pixel pitch is 100 $\mu$m or smaller.

In addition, settled phosphor scatters light generated by the x-rays. The lateral spreading of the light is approximately equal to the thickness of the layer. For settled phosphor, spatial resolution becomes finer, but the quantum efficiency decreases as the thickness of the phosphor decreases. Optimized thin photoconductors are expected to produce smaller spread. Although the light spread may be less of a problem for thick collimated CsI phosphor, the boundaries of the CsI grains are not perfect.

Furthermore, spatial resolution can be degraded due to x-rays striking the detector at an oblique angle. This problem exists for both direct and indirect x-ray converters. The extent of the charge spread collected by the detector is a function of the incidence angle. Since the x-ray incidence angle is a function of location on the detector relative to the x-ray point source, the modulation transfer function (MTF) of conversion blurring and oblique x-ray incidence blurring $MTF_{conversion}$ is also a function of the location on the detector. The $MTF_{conversion}$ of for Lanex Regular is much worse than Lanex Thin. The MTF of for Lanex Thin is 0.2, at 5 cycles/mm, as described in the article entitled "A Large-Area, 97 $\mu$m Pitch, Indirect-Detection, Active Matrix Flat-Panel Imager (AMFPI)", cited above.

The final system MTF is the product of the MTF associated with various components of the system, including the detector array MTF introduced by the detector pixel pitch and the MTF of conversion blurring. For these reasons, the reduction of pixel pitch alone is not as good the combination of reduction of pixel pitch and reduction of conversion blurring. The resolution of the detector is also effected by a variety of other factors that will not be discussed in detail here such as signal statistical noise, charge conversion noise and electronic noise.

Gamma rays are radiation generated by nuclear process. The energy of gamma rays are typically higher than that of the x-rays, but low energy range of the gamma rays can overlap the high energy end of the x-rays. These detector concepts can also be applied to the detection of gamma rays and megavolt radiation. A thick scintillator or a metal plate/phosphor screen combination is used. This is described in a publication by L. E. Antonuk, et al., "Demonstration of Megavoltage and Diagnostic X-ray Imaging with Hydrogenated Amorphous Silicon Arrays," *Med. Phys.* 19: 1455 (1992), the entire contents of which is incorporated by reference herein.

In summary, the major problems expected with small pixel detector development are complicated circuit architecture, increased number of leads to be bonded, the small pitch of the leads necessary for bonding, and resolution being increasingly dominated by scintillator blurring and the oblique x-ray incidence effect. These drawbacks result in decreased manufacturing yield, high risk and expensive development.

Accordingly, a continuing need exists for an apparatus capable of obtaining high-resolution digital x-ray or gamma ray images without the drawbacks discussed above.

SUMMARY OF THE INVENTION

An object of the present invention is to provide a method and apparatus for obtaining high-resolution digital x-ray or gamma ray images of an object or objects emitting x-rays or gamma rays, or of an object or objects irradiated with radiation having a wavelength within the x-ray or gamma ray spectrum.

Another object of the present invention is to obtain digital x-ray or gamma ray images at a resolution better than the pixel pitch of the detectors used to obtain the digital images.

Another object of the present invention is to reduce scattered x-rays or gamma rays detected by the digital detector while also improving image resolution.

A further object of the present invention is to minimize blurring of the digital x-ray or gamma ray images which can occur when the x-rays or gamma rays are directly converted into electron-hole pairs in a photoconductor and collected by the active area of the digital detectors.

A still further object of the present invention is to minimize blurring of the digital x-ray or gamma ray image which occurs when the x-rays or gamma rays are indirectly converted into electric charges first by converting x-rays or gamma rays to a longer wavelength radiation, for example, optical radiation, and then collecting and converting these radiation and converting them to electrical charge.

These and other objects of the present invention are substantially achieved by providing an apparatus and method for obtaining a digital image of an object or objects generating x-rays or gamma rays, or of object or objects irradiated with radiation having a wavelength in the x-ray or gamma ray spectrum generated by a radiation source. The apparatus comprises a detector matrix and a radiation mask. The detector matrix comprises a plurality of two-dimensional array of detector pixels, each of which comprises a detection surface having a respective active surface area and being adapted to generate an electrical signal in response to a radiation stimulus applied thereto. The radiation mask has an opaque portion and a plurality of apertures therein. The mask is positioned between the detector matrix and the radiation source. The radiation can pass through the mask to the detector only through the apertures of the mask. The image resolution is related to the aperture size and system configuration. Many modes of operation of this detector system are described below.

In the first mode of operation, the detector images object or objects that give radiation. The mask is placed between the object and the active detector pixels. The mask allows radiation from selected portions of the objects to be imaged by the detector for a single imaging frame.

In the second mode of operation, the object or objects are placed between a radiation source and the mask. Again, the mask allows a selected portion of the object or objects to be imaged by the detector for a single image frame.

In the third mode of operation, the object or objects are placed between the mask and the detector array, such that the opaque portion of the mask prevents portions of the radiation from passing therethrough, and each of the apertures permits a portion of the radiation which has passed through a respective portion of the object or objects to pass therethrough and propagate onto an active area of the detection surface of a respective one of the detector pixels. The detector pixels therefore each output a respective signal of the respective portion of the object.

The imaging apparatus further includes a conveying device which moves the detector matrix and radiation mask in unison in relation to the object to enable the areas of the detection surfaces of the detector pixels to receive portions of the radiation propagating through other portions of the object, and to output signals representative of those other portions. In particular, the detector matrix and radiation mask are moved along a pattern of movement in increments which are a fraction of the pixel pitch of the detector pixels. After each exposure of the detector to the radiation source, the charges collected by the detector array are read out to a computer and the detector array is reinitialized and the detector and mask are moved to the next appropriate position. This process is repeated so those portions of the object or objects which would not normally be imaged by this detector in the stationary mode can be imaged. These steps of moving the detector pixels and mask, and irradiating the object, are repeated until digital images of all portions of the object or objects have been obtained. The digital data are then arranged into an image representative of the entire object or objects.

BRIEF DESCRIPTION OF THE DRAWINGS

The various objects, advantages and novel features of the present invention will be more readily appreciated from the following detailed description when read in conjunction with the accompanying drawings, in which.

DETAILED DESCRIPTION OF THE PREFERRED EMBODIMENTS

Figure 1:
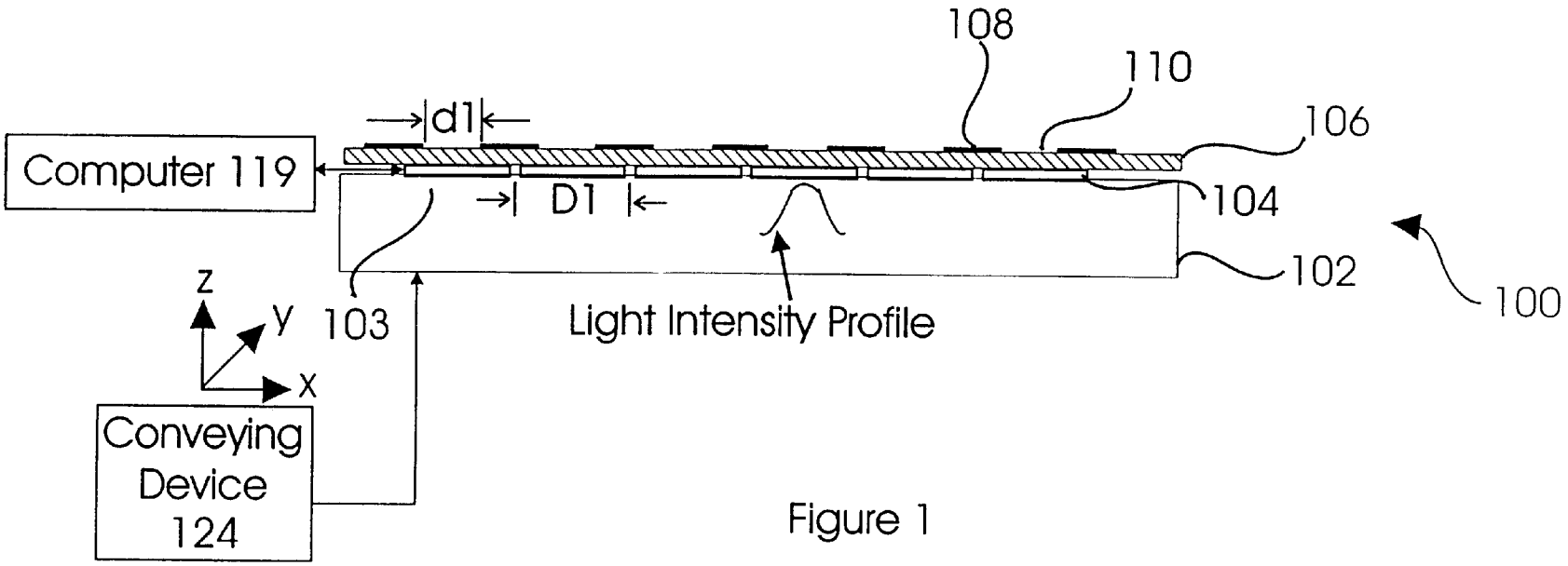
FIG. 1 is a schematic side view illustration of a high-resolution x-ray or gamma ray imaging apparatus according to an embodiment of the present invention.

An embodiment of a high-resolution x-ray or gamma ray imaging apparatus 100 is exemplified in FIGS. 1–7*b*. In particular, FIG. 1 is a schematic diagram illustrating a view of a side of the imaging apparatus 100 lying in the x-z plane. The imaging apparatus 100 includes a substrate 102, which can be a silicon or glass substrate or any other appropriate material as described in the Background section above, a detector pixel array 103 with detector pixels 104 which are disposed on the substrate 102, and a scintillator 106. The active area of the detector pixels 104 can be any type of pixel as described in the Background section above.

In this embodiment, the scintillator 106 converts x-rays or gamma rays to electron-hole pairs or visible photons. The electron hole pairs or visible photons are converted to electrical charge, current or voltage collected on the active radiation detector area of the pixel 104. In the typical digital x-ray or gamma ray detectors and visible imagers, the active area of the detector pixels 104 each measure the amount of charge collected per pixel. In general, the active area of the detector pixel 104 measures the change of electrical properties, material properties, physical properties, and so on, produced by the variation of the electromagnetic radiation intensity on the active area of the detector pixel 104.

A mask or mask/antiscatter grid 108 (hereinafter "mask 108") having aperture openings 110 therein is disposed on the upper surface of the scintillator 106. Each aperture opening 110 is aligned with a corresponding active area of the detector pixel 104 as shown. For many applications, the mask 108 can be rigidly attached to the scintillator 106, or can be directly attached to the active area of the detector pixels 104. The mask 108 must be opaque enough to substantially block the penetration of the electromagnetic radiation except through the aperture openings 110.

The active area of each detector pixel 104 is larger than its respective aperture opening 110, and detects the electromagnetic radiation (x-rays or gamma rays) passing through its respective aperture opening 110. As discussed below, the size of the aperture openings 110 and the number of images taken, not the detector pixel pitch, determines the image resolution.

The detector shown in FIG. 1 can be used to image objects that radiate x-rays or gamma rays. For example, the detector can be used for x-ray astronomy.

Figure 2:
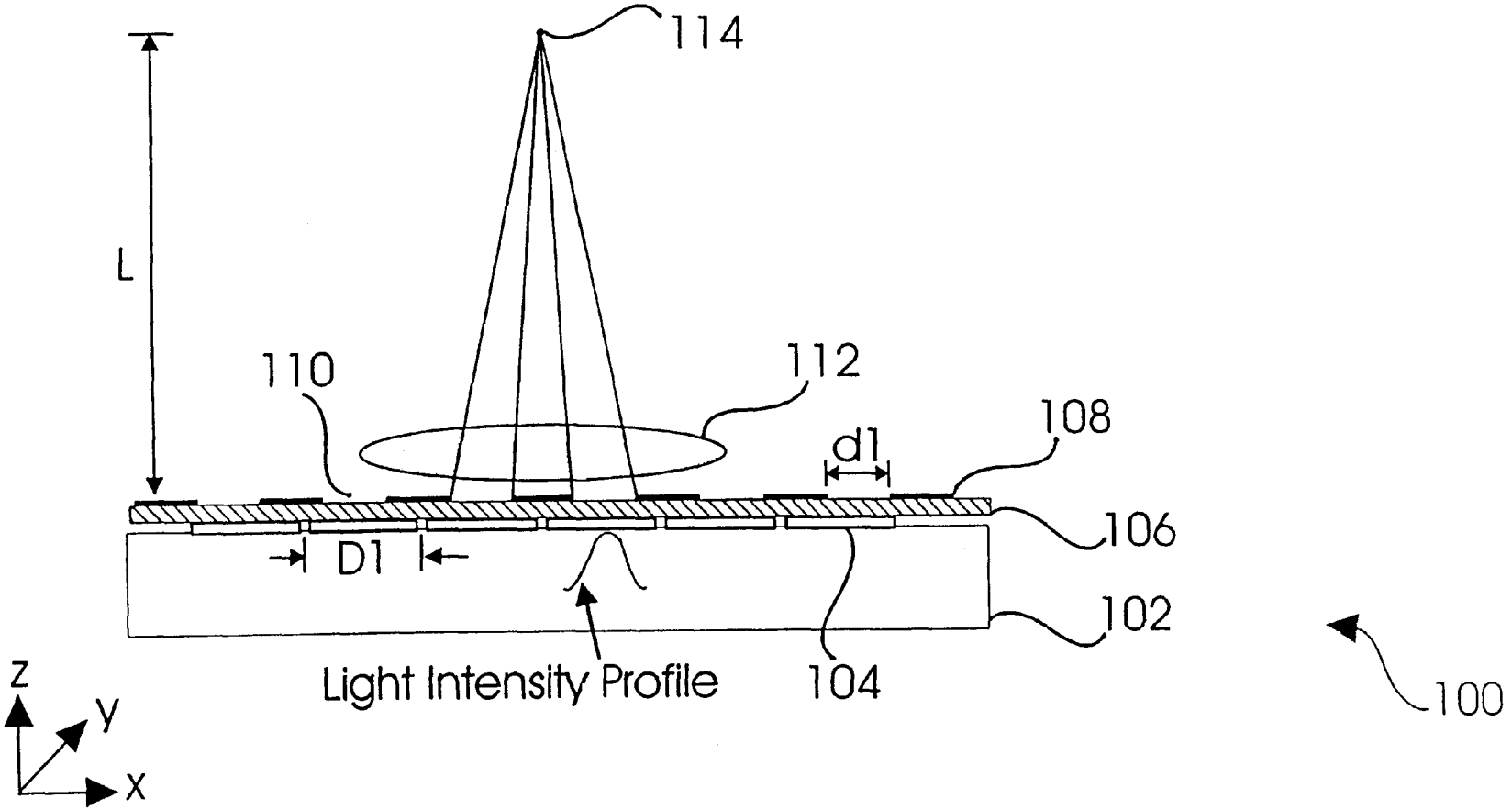
FIG. 2 is a schematic illustration of the high-resolution imaging apparatus shown in FIG. 1 in relation to an object being imaged and a point x-ray or gamma ray source.

FIG. 2 is a schematic drawing illustrating a side view of the embodiment of the imaging apparatus 100 shown in FIG. 1 being used in an x-ray radiography application to image the interior of an object 112, which can be, for example, a human body (or a portion thereof) or any other object. An x-ray source 114 is also illustrated schematically. Also, the source 114 could be a gamma ray source, or any energy source.

As shown, the object 112 to be imaged is positioned between the x-ray source 114 and the x-ray mask 108 of the imaging apparatus 100. After the x-ray source 114 emits a pulse of x-rays and the x-rays penetrate the object 112, the x-rays reach the mask 108. The mask 108 blocks all the x-rays from hitting the scintillator 106 except at the mask openings 110.

The scintillator 106 can be a phosphor screen, which converts the x-rays to optical radiation, and the photodiodes on each detector 104 covert the optical radiation to electrical charge. Alternatively, the scintillator 106 can be of the type that converts the x-rays directly to charge, such as a photoconductor, photocathode, or the like. The geometry and dimensions of the active area of the detector pixels 104 and x-ray mask openings 110 are such that the x-rays passing through a single mask or mask/antiscatter grid opening 110 will strike preferably only a single detector pixel 104. Preferably, the active detector area of one pixel 104 captures the charges created by one x-ray beamlet. The charge collected per pixel is then output via data lines (see FIG. 6), and processed in a manner known in the art.

The arrangement of the imaging apparatus 100 will improve the detector system MTF and increase the Nyquist frequency of even the existing best known detector pixels arrays to obtain a resolution much higher than that obtained by the same detector without a mask and without motion. The detector system MTF is the product of MTF associated with various component of the detector. Two MTF will be discussed: MTF associated with detector geometry and MTF associated with x-ray conversion.

As will now be explained, the operation of the imaging apparatus 100 will improve MTF associated with the detector system geometry for detectors which perform either direct or indirect conversion of the x-rays or gamma rays as discussed above.

Figure 3B:
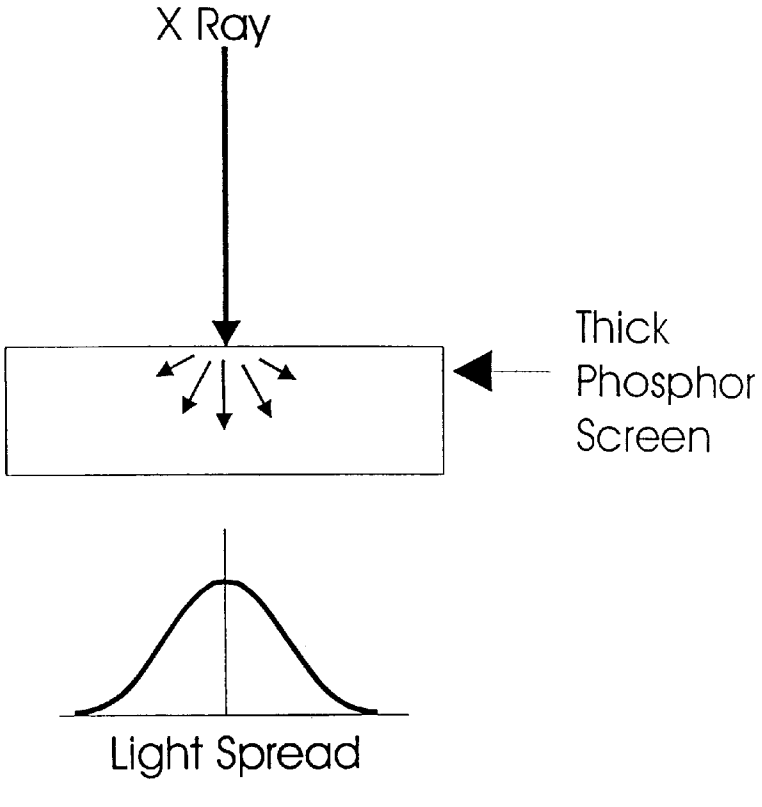
FIGS. 3*a* and 3*b* are schematic illustrations showing the scattering of light generated in phosphor screens by incident x-ray energy in relation to the thickness of the phosphor screens which can be employed to perform x-ray conversion in the imaging apparatus shown in FIGS. 1 and 2.
Figure 3A:
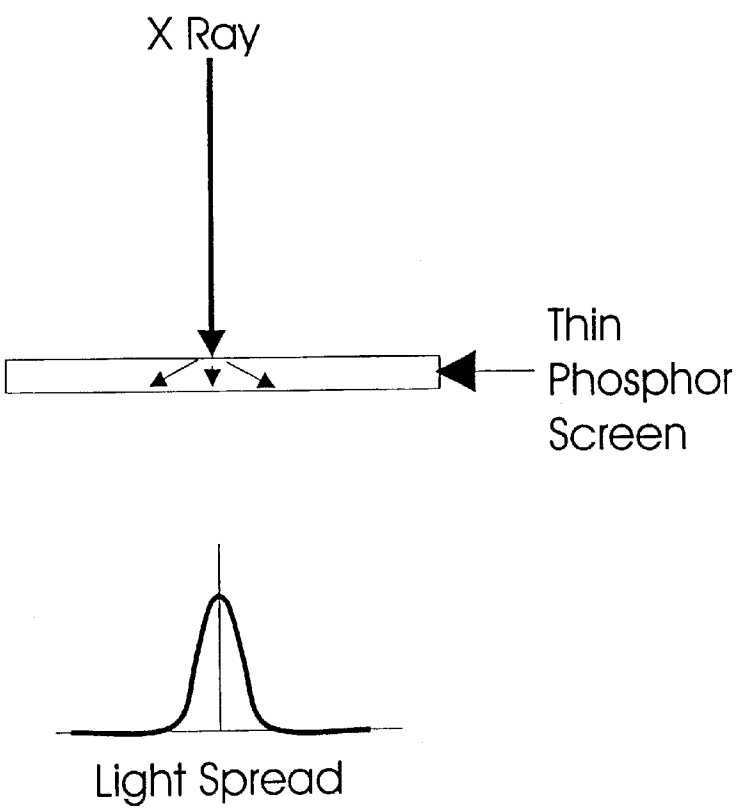

FIGS. 3*a* and 3*b* are schematic diagrams illustrating the manner in which phosphor screens scatter the light generated by the x-rays during indirect x-ray conversion. As shown, the light scatter is proportional to the thickness of the phosphor screen. A thicker phosphor screen will provide a greater light scatter.

Figure 4:
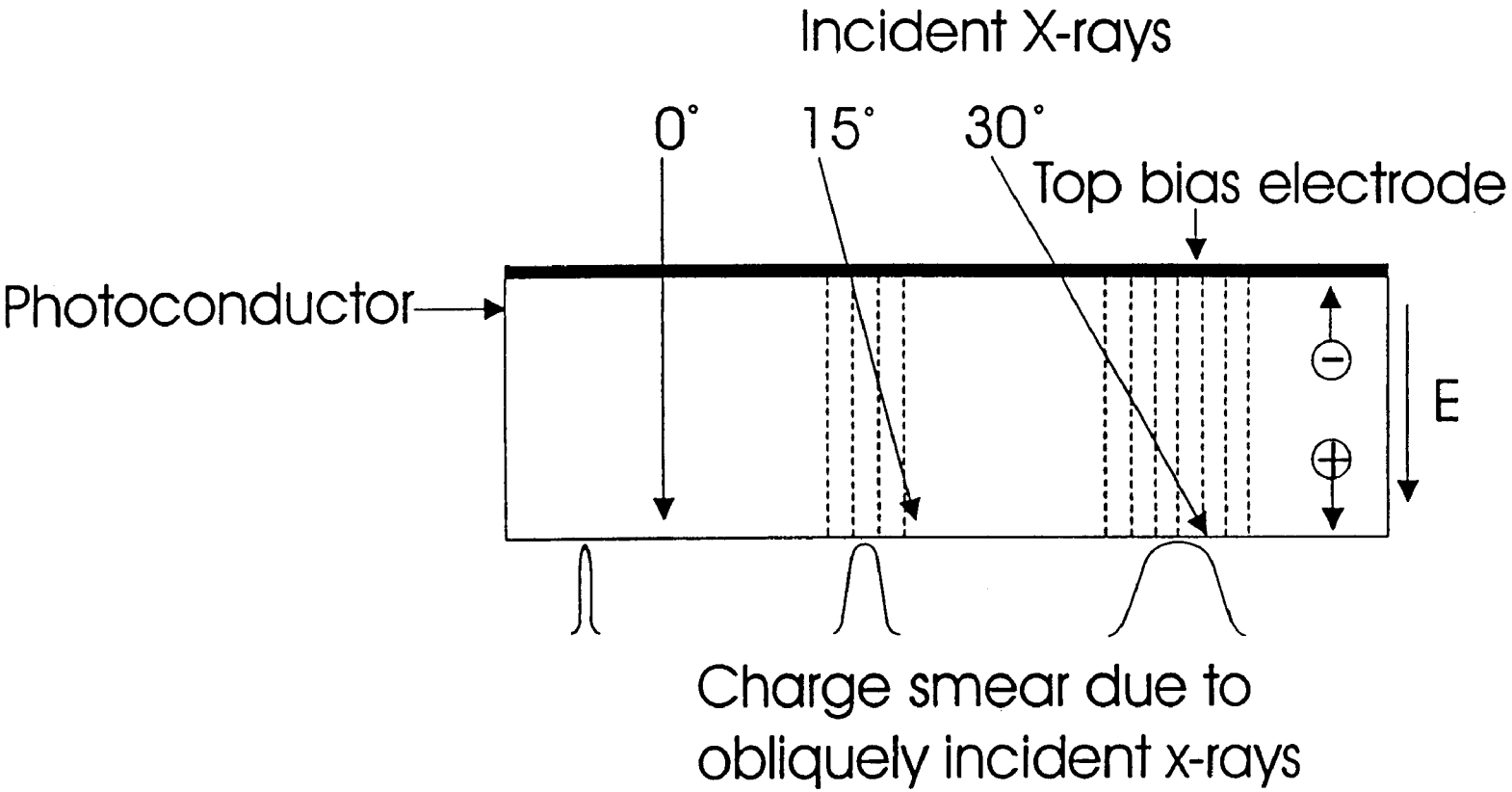
FIG. 4 is a schematic illustration showing charge smear generated in a photoconductor, which can be employed to perform x-ray conversion in the imaging apparatus shown in FIGS. 1 and 2, in relation to various angles of incidence of x-ray energy striking the photoconductor.

FIG. 4 is a schematic diagrams illustrating that for direct conversion of x-rays, charge smear is minimal when the x-ray incidence angle is zero degrees, and increases as the x-ray incidence angle increases. For both of these situations, an active pixel detector area much larger than the x-ray mask aperture will reduce conversion blurring and improve conversion MTF.

Figure 5:
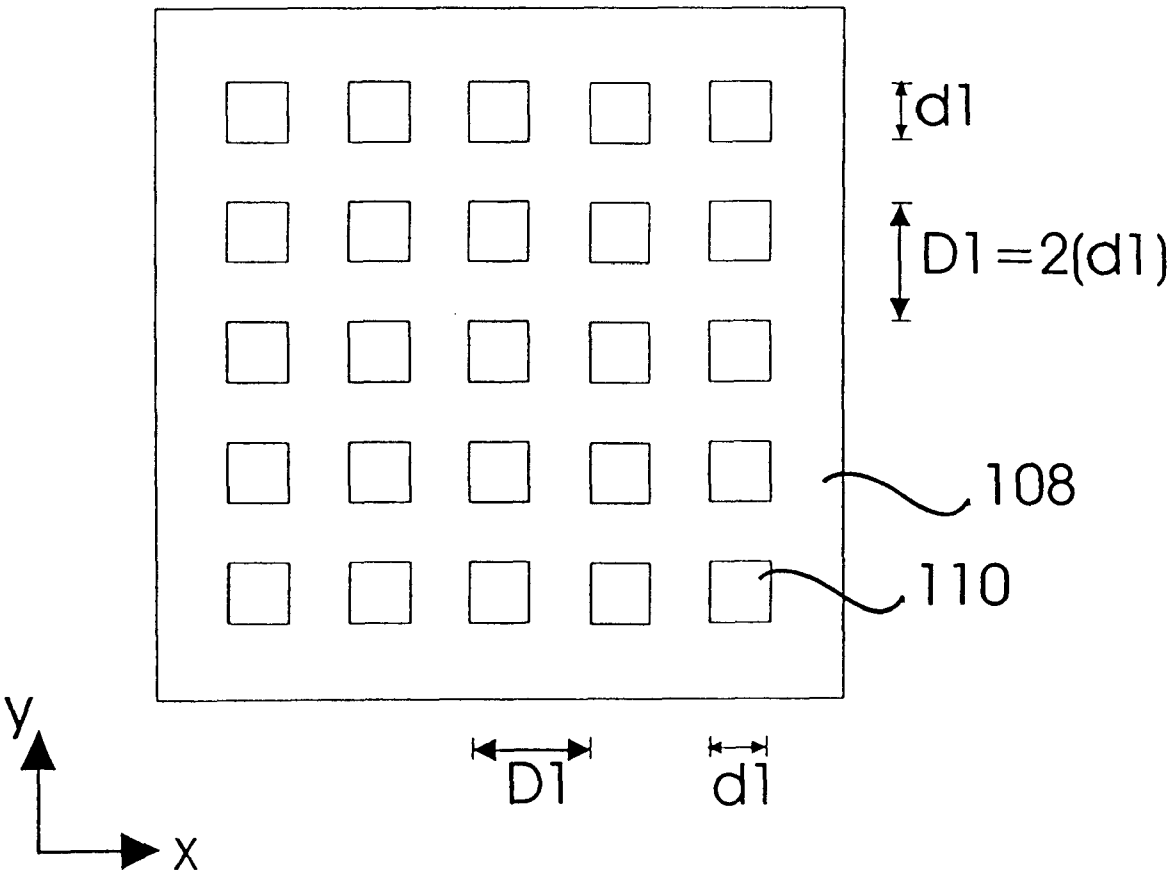
FIG. 5 is a schematic illustration of a top plan view of a mask which can be employed in the imaging apparatus shown in FIGS. 1 and 2.

The active area of the detector pixels 104 and mask 108 can have a wide range of pattern or layout. For example, FIG. 5 is a schematic diagram of mask 108 of the imaging apparatus, with apertures 110 viewed in the x-y plane in FIG. 1. The apertures 110 are square or essentially square, and each have a length and width equal to d1. The area of each aperture is d1×d1, and the pitch of the aperture is equal to the pixel pitch D1 in both directions. The arrangement of the apertures 110 forms a uniform grid of openings in the mask 108. As discussed above, the electromagnetic radiation to be detected has to be completely blocked by the mask 108 except at apertures 110 in the mask 108. The apertures 110 are used to control the area and position at which the electromagnetic radiation hits the detector pixels.

In this embodiment, the pixel pitch D1 is an integer multiple of d1. To enable the object to be 112 imaged without missing any areas and without double-exposing any areas, the imaging apparatus 100 is configured and operated so that the beamlets will each "fit" into a respective active area of the detector pixel 104 an exact number of times. In other words, D1=nd1, and n is an integer equal to or greater than 2. FIG. 5 shown an aperture arrangement where D1=2d1.

Figure 6:
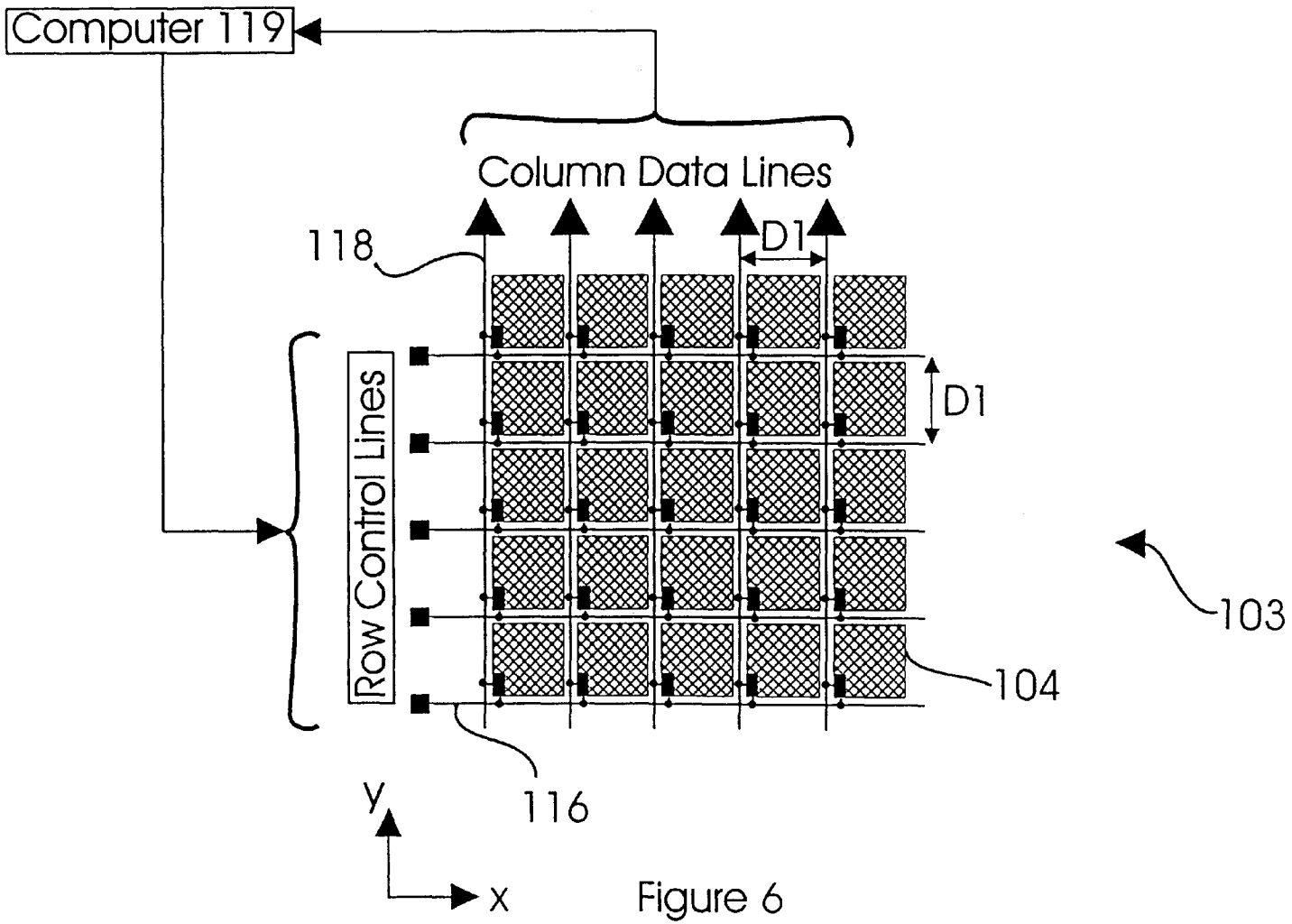
FIG. 6 is a schematic top plan view of an example of a detector pixel array which can be employed in the imaging apparatus shown in FIGS. 1 and 2.

FIG. 6 is a generalized schematic illustration of a top view of a possible layout of the detector pixel array 103 and the active area of the detector pixels 104 for the imaging apparatus 100 as shown in FIGS. 1 and 2. The active radiation detector areas of the pixels 104 are shown shaded with hatched lines. It is noted that the dimensions of the active area of the detector pixels 104 vary greatly from one manufacturer to another, and that the shapes of the active radiation detector areas of the pixels 104 can vary widely and are represented as squares only for illustration purposes. Row control (selection) lines 116, which are disposed on the substrate 102 (see FIGS. 1 and 2), are spaced uniformly from each other at the distance D1 as shown. Column data lines 118, which are also disposed on substrate 102, are also spaced uniformly from each other at the distance D1. Typically, data is read out one row at a time (but could be more than one row at a time) through the column data lines 118 to a processing device, such as a computer 119 or the like, as controlled by the row control lines 116.

Figure 7B:
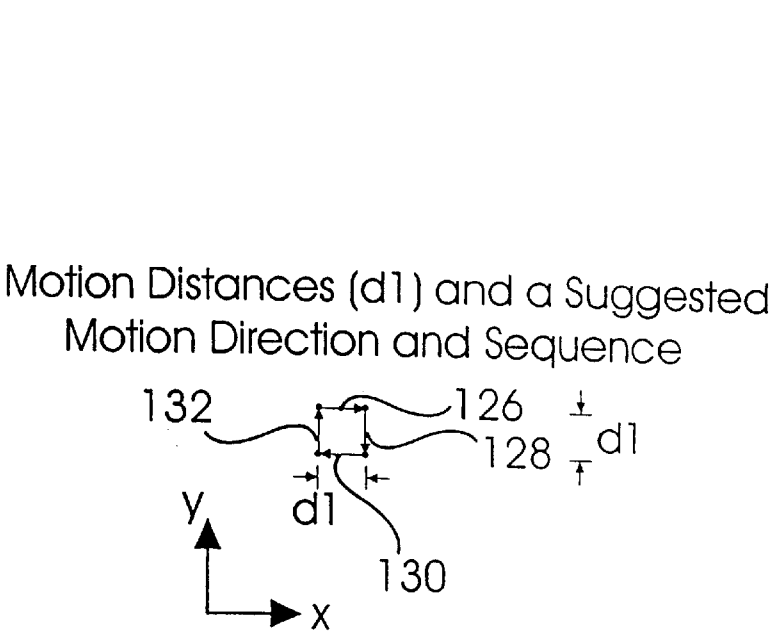
FIG. 7*b* is a diagram illustrating an exemplary sequence of movements of the detector pixel array shown in FIG. 6 and the mask shown in FIG. 5 of the imaging apparatus shown in FIGS. 1 and 2 with respect to the object being imaged according to an embodiment of the present invention.
Figure 7A:
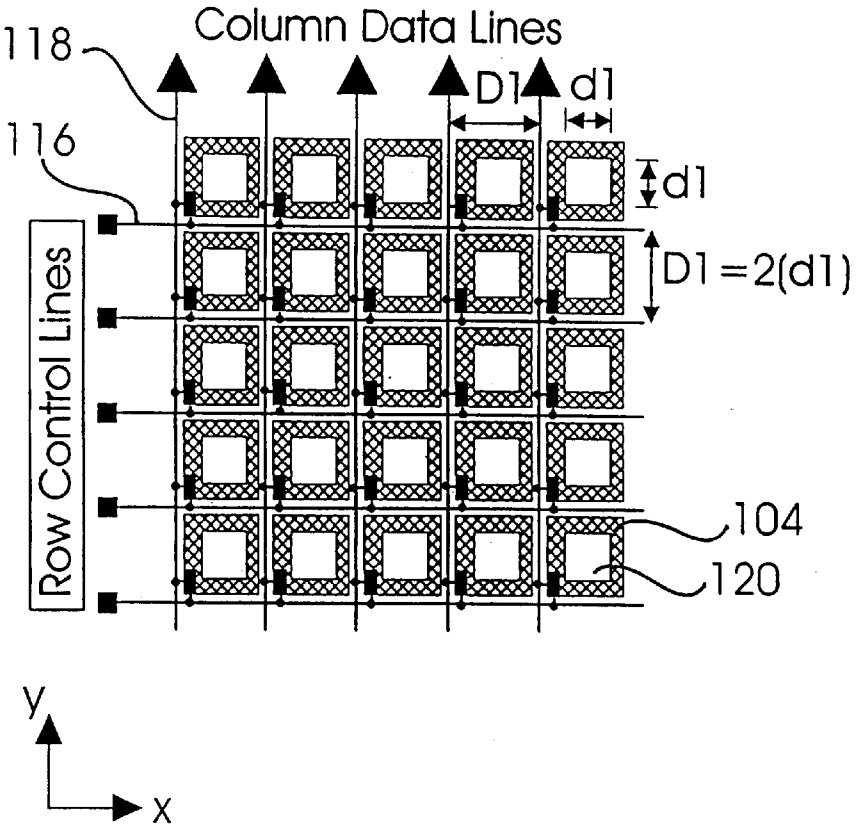
FIG. 7*a* is a schematic illustration showing the pattern of electromagnetic radiation which passes through the mask shown in FIG. 5 and strikes the scintillator adjacent the active area of the detector pixels of the detector pixel array shown in FIG. 6.

FIG. 7*a* is a schematic representation of the radiation beamlets 120 that pass through the apertures 110 of the mask 108 which has been superimposed over the active area of the detector pixels 104. Specifically, the electromagnetic radiation beamlets 120 are illustrated as white squares on the pixels 104, with each white square having a dimension d1×d1, which is equal to or essentially equal to the dimension of the aperture 110 through which the beamlet 120 has passed. In summary, as shown in FIG. 7*a,* the radiation beamlets 120 hit the scintillator above the active area of the detector pixels 104 with dimension d1×d1. The distance between the centers of adjacent apertures 110 is equal to D1, which is the pitch of the active area of the detector pixels 104. The relationship between the dimensions of each active area of the detector pixel and the dimensions of the radiation beamlets when they hit the detector pixel is D1=nd1, where n=2 in this example. Also, the x-rays are only allowed to impact the detector during the x-ray exposure time, but not during the data read out time or while the mask or detector is being moved.

To assure that the entire object 112 (FIG. 2) is imaged, a conveying device 124 (see FIG. 1), such as a stepper motor, servo motor, motorized table, or any other suitable device, is configured to move the imaging apparatus 100 in a controlled manner. The imaging apparatus 100 is moved with respect to the object 112 in increments equal to d1 along the pattern shown in FIG. 7*b*. That is, after one exposure of the object 112 to the x-rays, a x-ray image of a respective portion of the object 112 is obtained by each pixel 104. The data produced by the pixels 104 is output through the column data lines 118. The imaging apparatus 100 is then moved in the x-y plane by a distance d1 along an arrow in FIG. 7*b*.

This process is repeated $n^2$ times with the imaging apparatus 100 (i.e., the detector pixels grid 103, scintillator 106 and mask 108) moved systematically in the x-y plane, for example, in the directions along arrows 126, 128, 130 and 132 for each exposure and reading, so that every part of the object 112 is imaged. After all four x-ray image patterns ($n^2$=4 in this example) have been obtained and stored, they are reconstructed by a processing device, such as the computer 119 or the like into a complete image representative of the entire object 112. The reconstructed image has higher resolution than any single x-ray image pattern obtained with or without the mask 106.

The principle of improvement of image resolution is explained first assuming no x-ray conversion blurring and then expanded to include x-ray conversion blurring.

For the fill factor of the active area of the detector is 100%, $$MTF_{geometry}=\sin(\pi fD)/(\pi fD),$$

Where $MTF_{geometry}$ is the MTF associated with the geometry of the detector system in one direction, D is the dimension of the pixel pitch, and f is the spatial frequency. The Nyquist frequency is 1/2D.

When the linear dimension of the active area of the detector pixel is reduced to d1, for D=2d1, $$MTF_{geometry}=\sin(\pi f(d1))/(\pi f(d1)),$$

and the Nyquist frequency is still 1/2D.

When the linear dimension of the active area of the detector is d1 and D=2(d1), and the detector is moved as shown in FIG. 7*b* and D=2(d1), then $$MTF_{geometry}=\sin(\pi f(d1))/(\pi f(d1)),$$

and the Nyquist frequency is increased to 1/4D. This technique is used to reduce aliasing and improve image resolution for infrared cameras. The technique is called microscanning, dithering and microdithering, as described in the following publications: J. C. Gillette, T. M. Stadtmiller and R. C. Hardie, "Aliasing reduction in staring infrared imagers utilizing subpixel techniques," Optical Engineering 34, 3130–3137 (1995); R. C. Hardie, K. J. Barnard, J. G. Bognar, E. E. Armstrong and E. A. Watson, "High-resolution image reconstruction from a sequence of rotated and translated frames and its application to an infrared imaging system," Optical Engineering 37, 247–260 (1998), the entire contents of each being incorporated by reference herein.

For x-ray and gamma ray imaging, there is conversion blurring. Conversion blurring can eliminate the benefits of microscan without mask and significantly reduce the signal. For example, for a TFT digital x-ray detector having an active area of the pixel with a dimension d1×d1, if If N number of x-rays impinges on this active area of the pixel and M number of electrons are created per x-ray, then the total number of electrons created per pixel would be MN. When there is no conversion blurring, the total number of charge collected by this pixel would be MN. Due to conversion blurring, the percentage of charge collected by this pixel decreases as the pixel dimension decreases, and the remaining charges are spread to the neighboring pixels.

In the detector system of the present invention as shown, for example, in FIGS. 1–2, the aperture size of the mask determines the Nyquist frequency and the MTF associated with the pixel, while the active area of the pixel is kept large to increase the percentage of charge collected as the aperture of the mask decreases.

The small aperature of the mask and large detector pixel size also improves the MTF associated with the conversion blurring, $MTF_{conversion}$. The detector system MTF, $MTF_{system}$, is the product of the MTF associated with the various aspects of the system, $$MTF_{system}=MTF_{geometry}*MTF_{conversion}*MTF_{others},$$

Where $MTF_{others}$ is the MTF associated with other component of the detector system.

Figure 8:
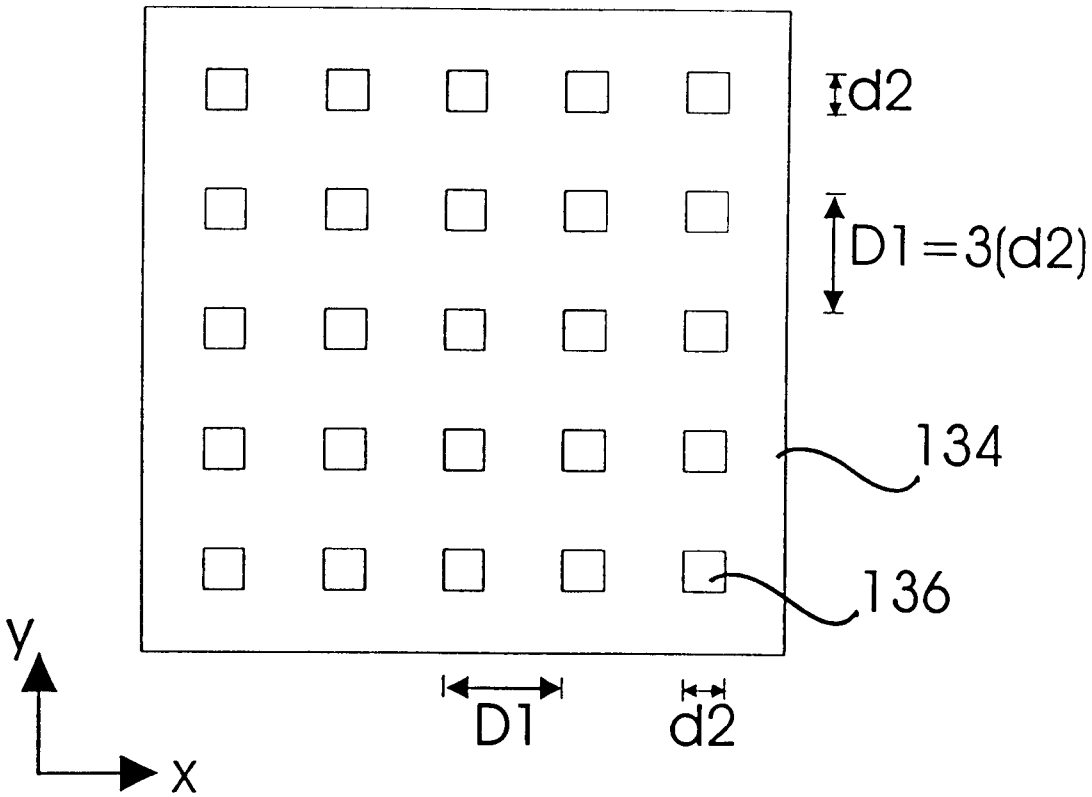
FIG. 8 is a schematic top plan view of another example of a mask which can be employed in the imaging system shown in FIGS. 1 and 2.

The detector system described in FIGS. 1–2 and 5–7*b* with a mask and motion has a higher Nyquist frequency, larger values for the MTF within the Nyquist frequency and improve signal as compared to imaging without the mask and motion. As explained above, the detector pixel array 103 and mask 108 arrangement can have a wide variation of patterns and dimensions. For example, FIG. 8 is a schematic of a top view of a mask 134 which can be used in the imaging apparatus 100 shown in FIGS. 1 and 2 instead of mask 108. Mask 134 includes apertures 136 which are square or essentially square and have a dimension d2×d2, such that the pixel pitch D1 of detector pixels 104 is equal to 3(d2), (D1=3(d2)) in both directions.

Figure 9A:
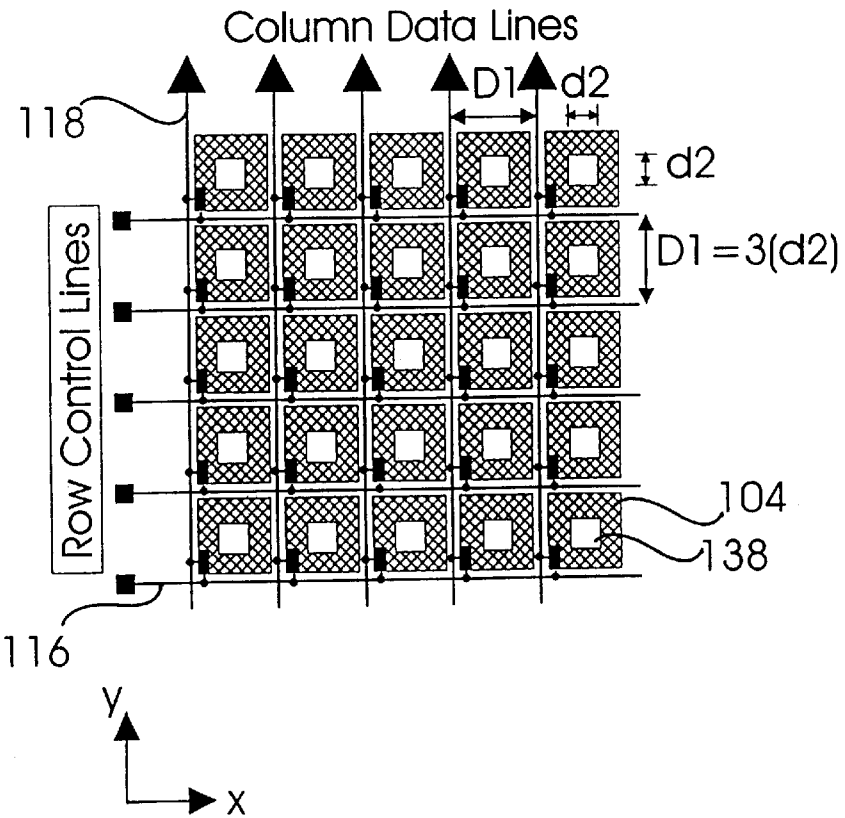
FIG. 9*a* is a schematic illustration showing the pattern of electromagnetic radiation which passes through the mask shown in FIG. 8 and strikes the scintillator adjacent the active area of the detector pixels of the detector pixel array shown in FIG. 6.

FIG. 9*a* is a schematic view showing the electromagnetic radiation that has passed through the mask 134 and has impacted on the scintillator above detector pixels 104. That is, the x-ray beamlets 138 pass through respective apertures 136 in the mask 134 and strike the center of the active radiation detection area of the respective pixel 104.

Figure 9B:
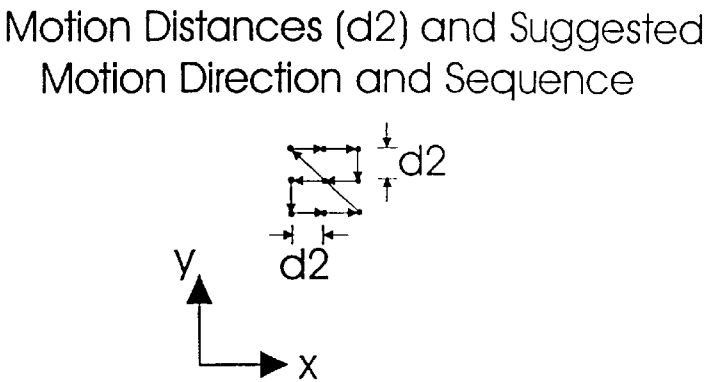
FIG. 9*b* is a diagram illustrating an exemplary sequence of movements of the detector pixel array shown in FIG. 6 and the mask shown in FIG. 8 of the imaging apparatus shown in FIGS. 1 and 2 with respect to the object being imaged according to an embodiment of the present invention.

To obtain an entire x-ray image of the object 112 with an imaging apparatus 100 including mask 134, the imaging apparatus 100 is moved along a pattern as shown, for example, in FIG. 9*b*. That is, as discussed above with regard to FIGS. 7*a* and 7*b*, after each exposure of the object 112 to x-rays and, generation of an x-ray image sub-pattern by the pixels 104, and read-out of the pixel data through column data lines 118, the imaging apparatus 100 is moved to a new location. The imaging apparatus 100 is moved sequentially each time an x-ray image is taken, and is moved in a possible pattern shown in FIG. 9*b* with each arrow representing one successive movement(d2=D/3). This process is repeated $n^2$=9 times with the detector 103, scintillator 106 and mask 134 moved in unison so that every part of the object 112 will be imaged. After all of the x-ray image sub-patterns have been obtained and stored, they are combined by a processor such as a computer or the like to provide an x-ray image representative of the entire object 112.

Figure 10:
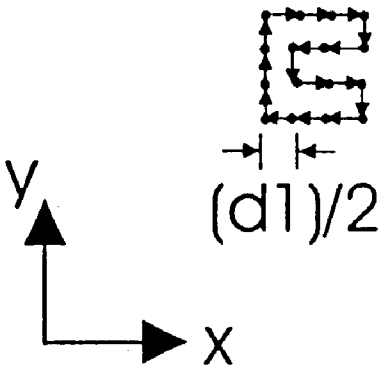
FIG. 10 is another diagram illustrating an exemplary sequence of movements of the detector pixel array shown in FIG. 6 and the mask shown in FIG. 5 of the imaging apparatus shown in FIGS. 1 and 2 with respect to the object being imaged according to an embodiment of the present invention.

In addition, aliasing can be further minimized and MTF improved by oversampling and applying appropriate mathematical algorithms. That is, returning to the example discussed with regard to FIGS. 7*a* and 7*b,* instead of moving the imaging apparatus 100 including detector 108 by a distance d1 between successive x-ray or gamma ray exposures, the imaging apparatus 100 is moved by a distance of (d1)/2=(D1)/2n, so the total number of sub-frames required is $(2n)^2$. The value (d1)/2=(D1)/2n. The arrows shown in the diagram of FIG. 10 suggest a possible sequence of movements for imaging apparatus 100 including detector pixels array 103, scintillator 106 and mask 108 for a detector motion of (d1)/2 between exposures, with the distance d1 being equal to one-half the pixel pitch D1 (i.e., D1/d1=2).

Figure 11:
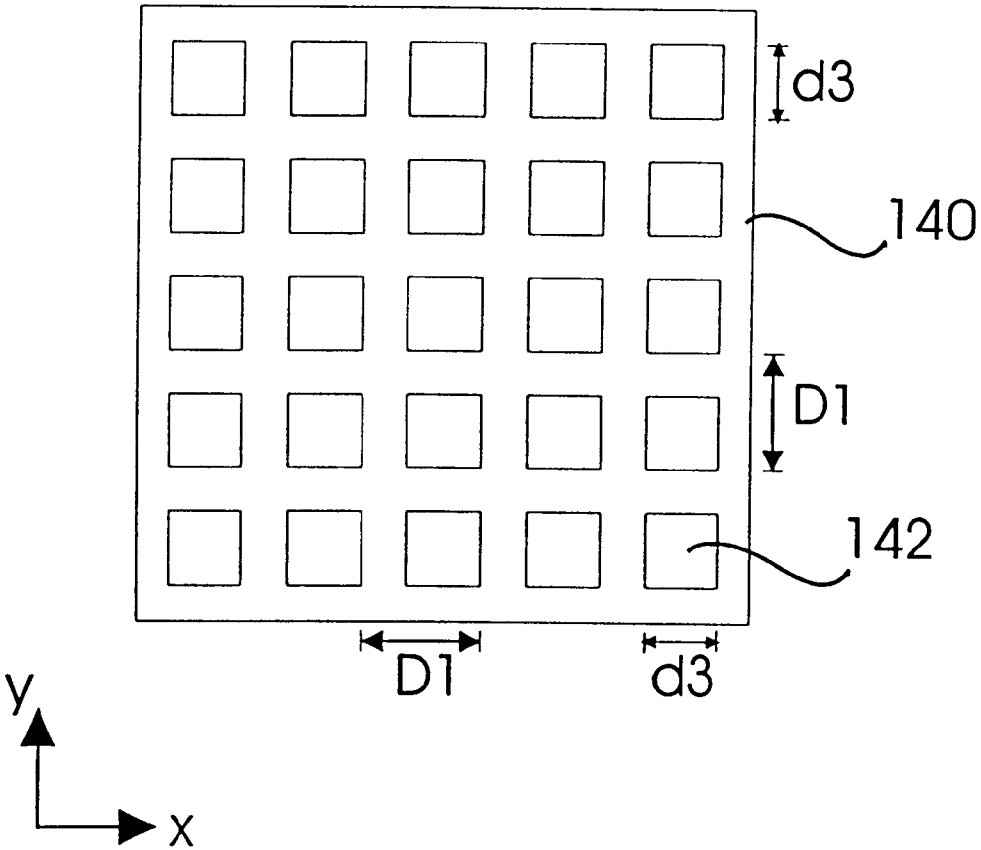
FIG. 11 is a schematic top plan view illustration of another example of a mask which can be employed in the imaging system shown in FIGS. 1 and 2.
Figure 12B:
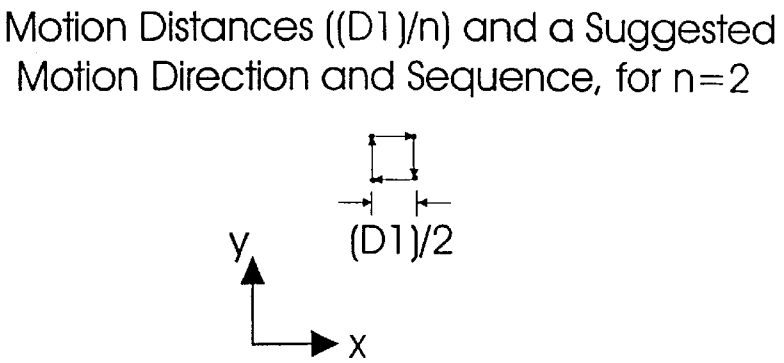
FIG. 12*b* is a diagram illustrating an exemplary sequence of movements of the detector pixel array shown in FIG. 6 and the mask shown in FIG. 11 of the imaging apparatus shown in FIGS. 1 and 2 with respect to the object being imaged according to an embodiment of the present invention.
Figure 12A:
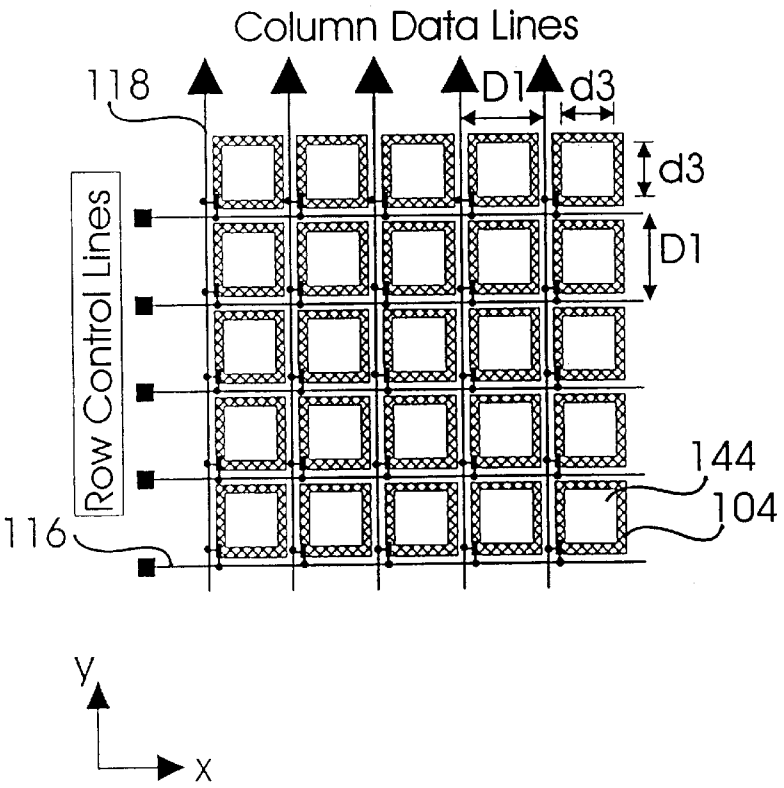
FIG. 12*a* is a schematic showing the pattern of electromagnetic radiation which passes through the mask shown in FIG. 11 and strikes the scintillator adjacent the active area of the detector pixels of the detector pixel array shown in FIG. 6.

An example of sampling variation by increasing the size of the apertures in the mask without changing the detector size or the distance between exposures is exemplified in FIGS. 11, 12*a* and 12*b*. FIG. 11 shows a mask 140 with apertures 142 each having a dimension d3×d3, where D1/(n−1)>d3>D1/n. In this example, n=2. FIG. 12*a* shows the spot size of the radiation beamlets 144 formed by mask 140 on the scintillator above the detector pixels 104. After each x-ray exposure and data readout operation is performed in the manner discussed above, the detector is moved a distance D1/n along the arrows shown in FIG. 12*b*. This process is repeated $n^2$ times with the detector 103, scintillator 106 and mask 140 moving in unison so that every part of the object 112 is imaged. The suggested motion is similar to that of the example showing FIG. 10 to reduce aliasing. The aliasing reduction is dependent on the amount of overlapping image.

Figure 13:
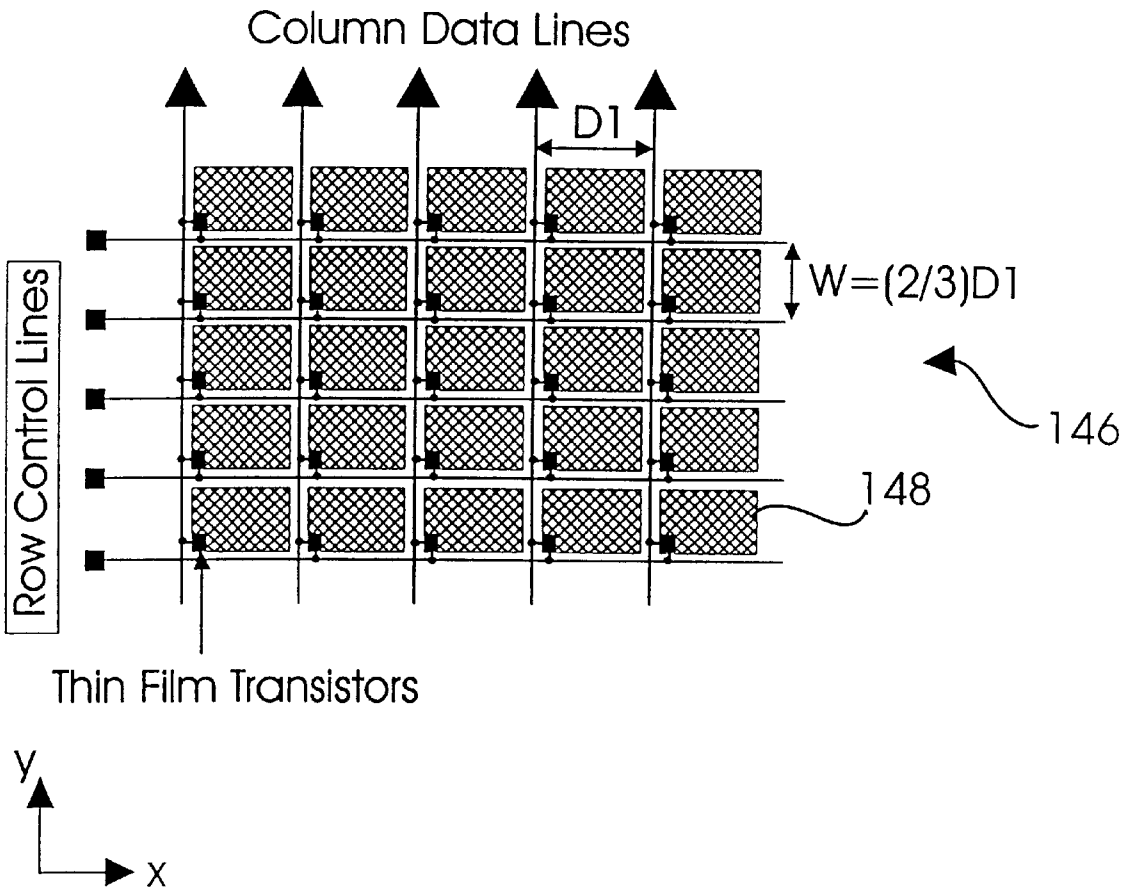
FIG. 13 is a schematic top plan view of another example of a detector pixel array which can be employed in the imaging apparatus shown in FIGS. 1 and 2.

It is noted that the periodicity of the detector pixel pitch need not be square. For example, as shown in FIG. 13 shows a detector pixel array 146 having the active area of the detector pixels 148 within the D1×0.75(D1) pixel pitch. For some applications, a rectangular area of the detector pixel layout is more effective than a layout of square detector pixels.

Figure 14:
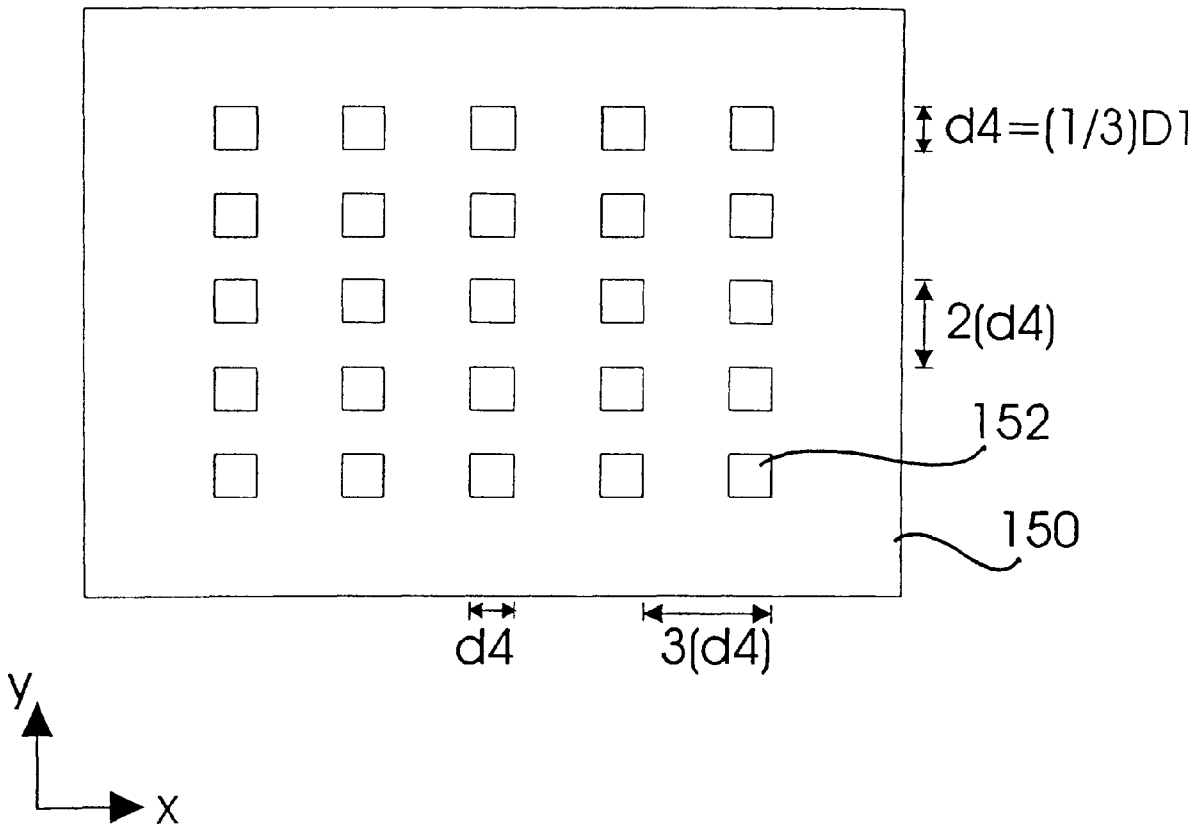
FIG. 14 is a schematic top plan view of another example of a mask which can be employed in the imaging system shown in FIGS. 1 and 2.

FIG. 14 is a schematic illustration of a mask 150 having apertures 152 appropriate for the detector pixels 148 shown in FIG. 13. In this example, n=D1/d4=3.

Figure 15A:
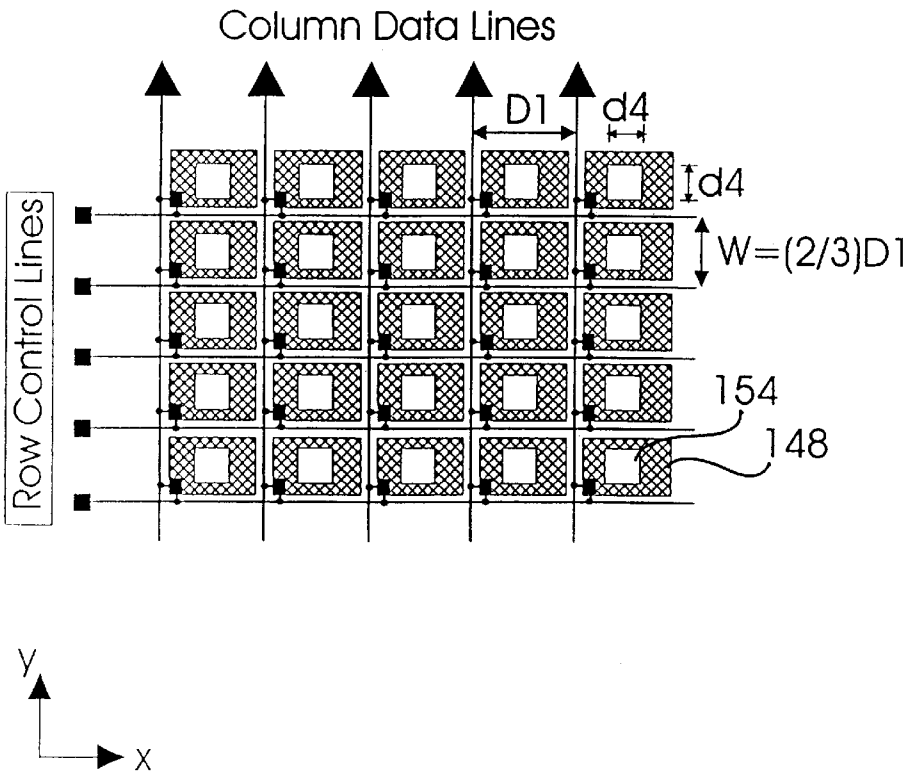
FIG. 15*a* is a schematic illustration showing the pattern of electromagnetic radiation which passes through the mask shown in FIG. 14 and strikes the scintillator adjacent the active area of the detector pixels of the detector pixel array shown in FIG. 13.
Figure 15B:
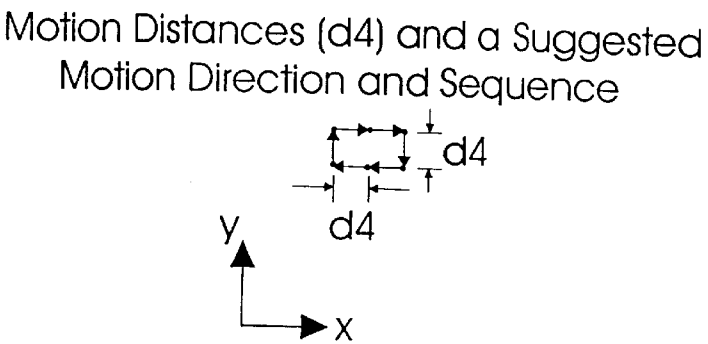
FIG. 15*b* is a diagram illustrating an exemplary sequence of movements of the detector pixel array shown in FIG. 13 and the mask shown in FIG. 14 of the imaging apparatus shown in FIGS. 1 and 2 with respect to the object being imaged according to an embodiment of the present invention.

FIG. 15*a* is a schematic diagram illustrating the location of the radiation beamlets 154 passing through the apertures 152 of the mask 150 onto the scintillator above the detector pixels 148. Preferably, the x-ray beams that pass through each aperture 152 in the mask 150 are centered on the active radiation detection area of a respective pixel 148. After each x-ray exposure to the object 112 and data readout is performed in the manner discussed above, the imaging apparatus 100 including detector pixel array 146 and mask 150 is moved a distance (D1)/4 along the arrows shown in FIG. 15*b*. This process is repeated 6 times with the detector grid 146 and mask 150 moved systematically so that every part of the object 112 will be imaged.

Figure 16:
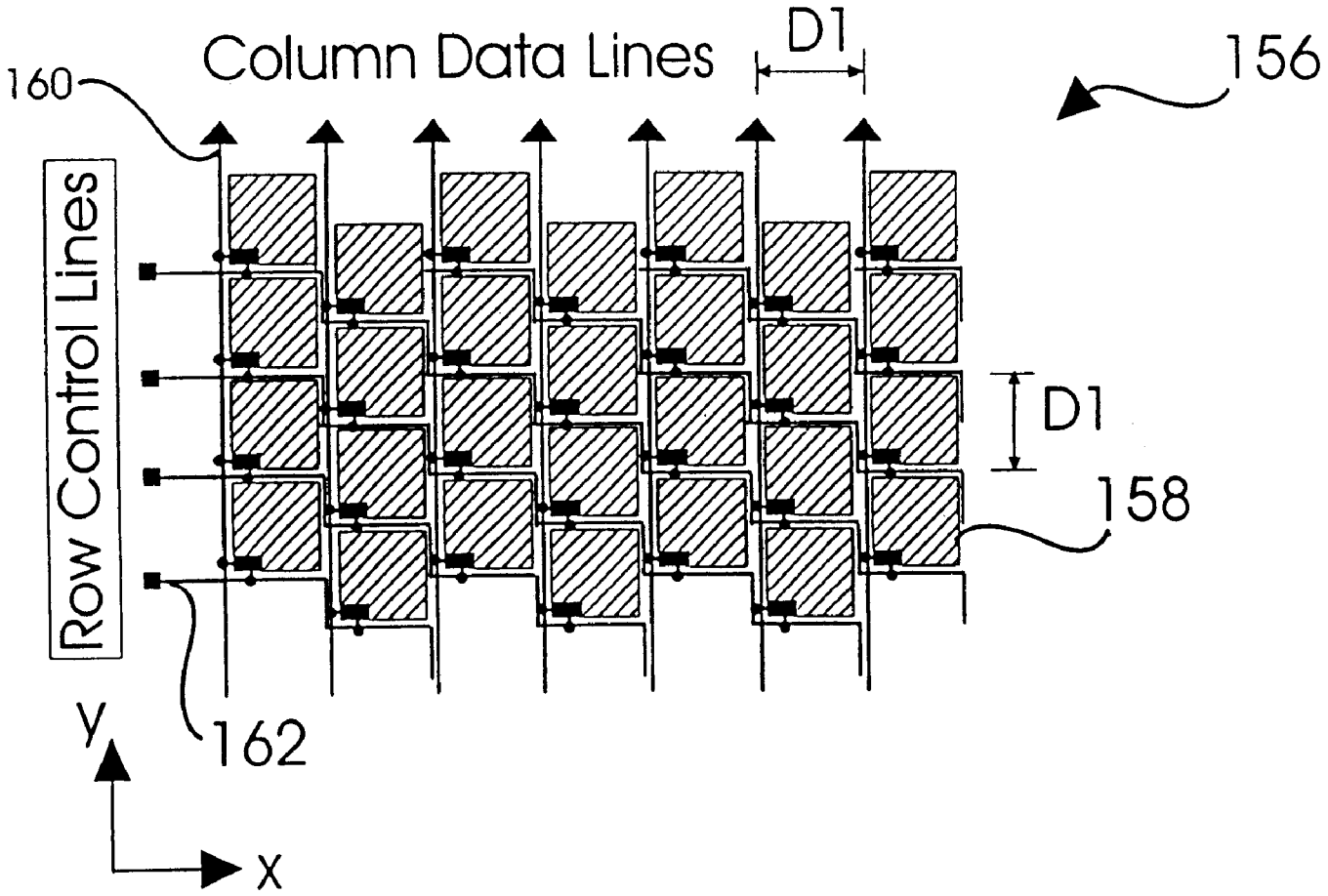
FIG. 16 is a schematic top plan view of another example of a detector pixel array which can be employed in the imaging apparatus shown in FIGS. 1 and 2.

FIG. 16 is a schematic of a top view of a variation in the layout of the detector pixels for the imaging apparatus 100 shown in FIGS. 1 and 2. In the pixel array 156, the active areas for radiation detection of the pixels 158 are shown shaded with hatched lines. The shape of each pixel 158 is shown as a square for schematic purpose only. In general, the pixel shape can vary from one product to another and from one manufacturer to another.

As shown, the detector pixels 158 are staggered in formation. The periodicity of the pixel is 2D1 in the horizontal direction and D1 in the vertical direction. The arrangement further includes column data lines 160, which are similar to the column data lines 118 discussed above and are spaced uniformly a distance D1 apart. Each data line will be connected to all the pixels 158 in a respective column of pixels. Control lines 162 run in a staggered zigzag pattern from left to right in this embodiment, and are spaced uniformly a distance D1 apart.

Figure 17:
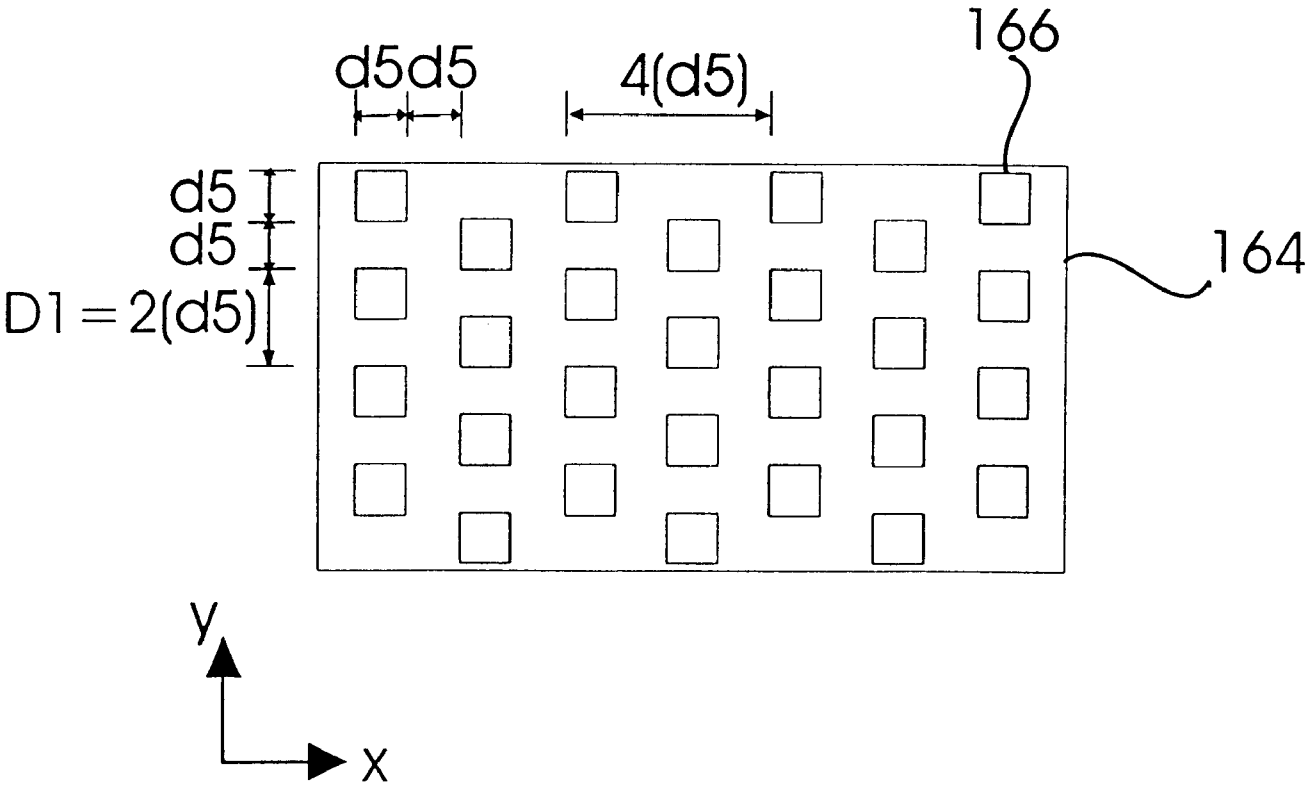
FIG. 17 is a schematic top plan view of another example of a mask which can be employed in the imaging system shown in FIGS. 1 and 2.

FIG. 17 is a schematic illustration of the aperture layout of the mask 164 employed in the imaging apparatus 100 shown in FIGS. 1 and 2 having a detector pixel layout as shown in FIG. 16. The apertures 166 are arranged in a staggered fashion as shown, and D1/(d5)=2.

Figure 18B:
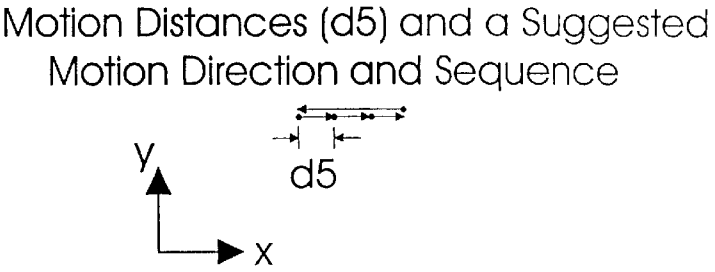
FIG. 18*b* is a diagram illustrating an exemplary sequence of movements of the detector pixel array shown in FIG. 16 and the mask shown in FIG. 17 of the imaging apparatus shown in FIGS. 1 and 2 with respect to the object being imaged according to an embodiment of the present invention.
Figure 18A:
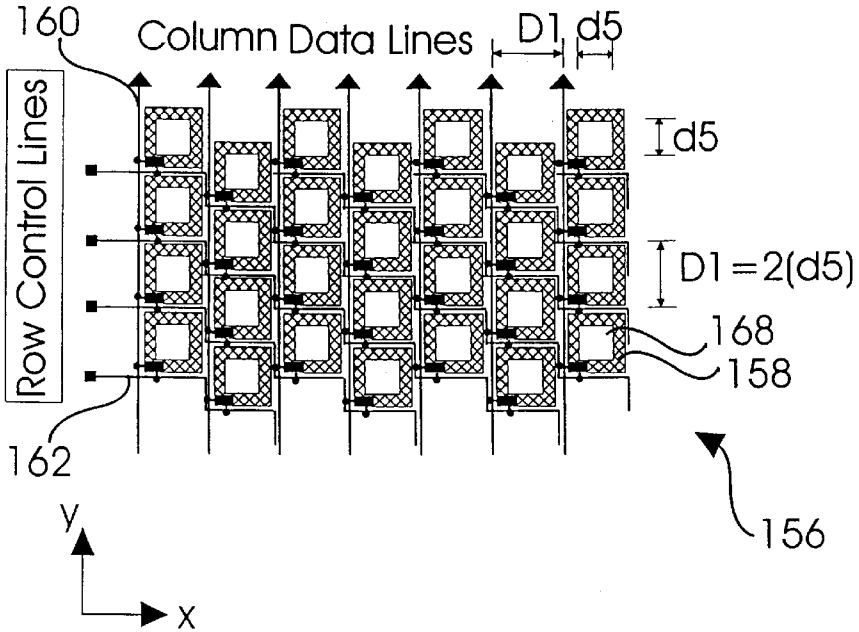
FIG. 18*a* is a schematic illustration showing the pattern of electromagnetic radiation which passes through the mask shown in FIG. 17 and strikes the scintillator adjacent the active area of the detector pixels of the detector pixel array shown in FIG. 16.

FIG. 18*a* is a schematic illustration showing the locations at which the radiation beamlets 168 pass thought the apertures 166 overlaying the detector pixel array 156. FIG. 18*b* is a diagram showing an example of movement of the mask 164 and detector pixel array 156 for four x-ray exposures and returning to its original position and image readings which occur in the manner discussed above. As shown, the mask 164 and detector pixel array 156 move along the arrows by a distance d5 between each exposure and image reading. The minimum number of exposures is $n^2$, and n=2 in this example.

In general, there are many variations in direction and distance in which the detector pixel array 156 and mask 164 can be moved. For instance, D1/(d5) can be any number greater than or equal to 2, and various image data sampling algorithms can be implemented. Also, the pixel pitch does not have to be square.

Figure 19:
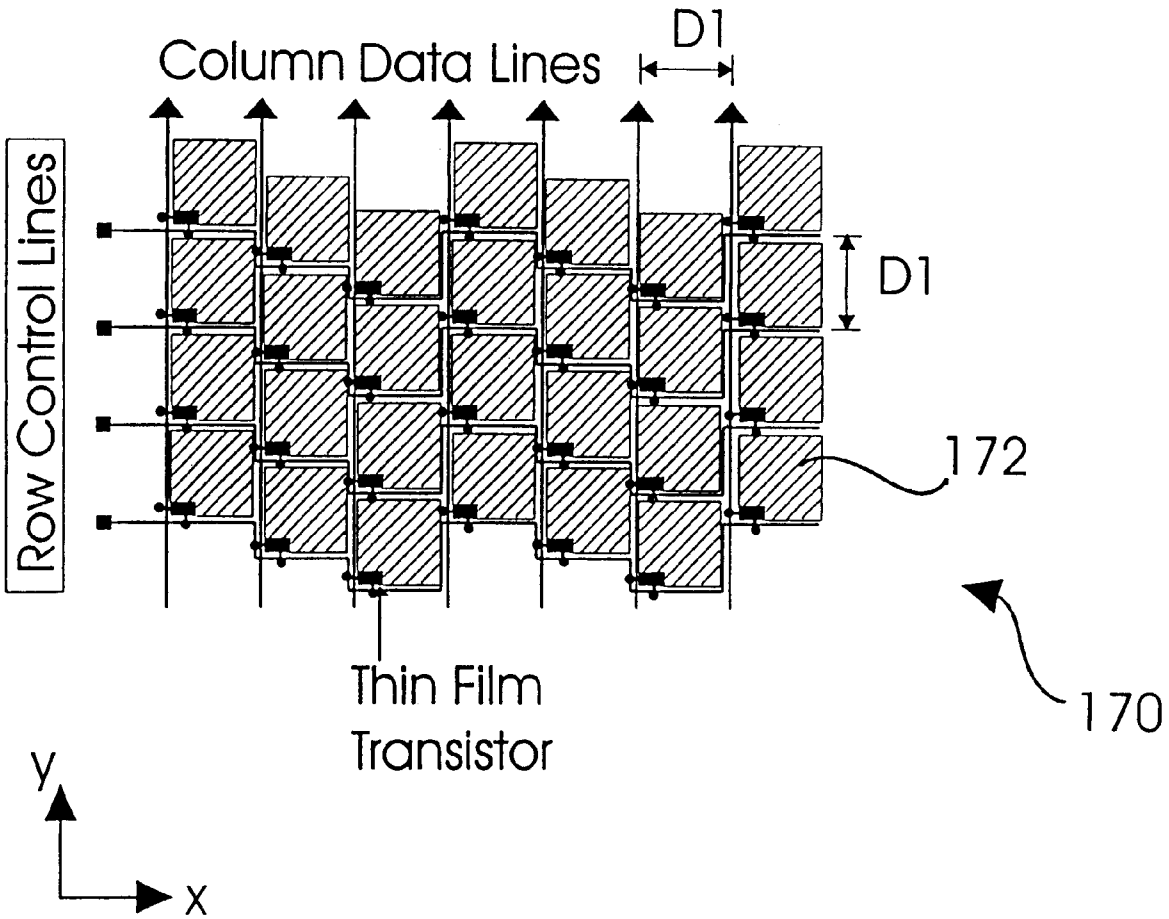
FIG. 19 is a schematic top plan view of another example of a detector pixel array which can be employed in the imaging apparatus shown in FIGS. 1 and 2.

For example, FIG. 19 is another schematic illustration of a top view of a detector pixel array 170 which can be employed in imaging apparatus 100 shown in FIGS. 1 and 2 in place of detector pixel array 103. This figure is similar to FIG. 16, except the periodicity of the pixel detectors 172 is 3(D1) in the x direction.

Figure 20:
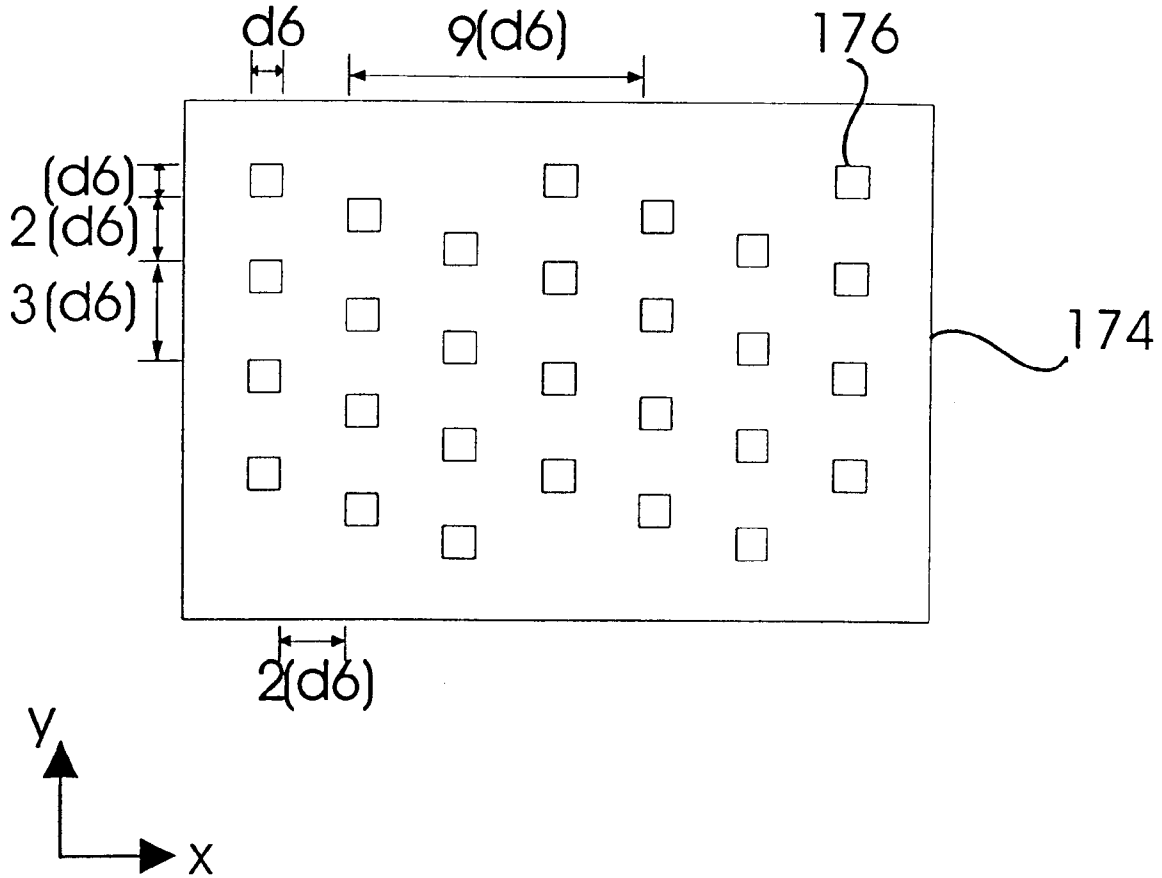
FIG. 20 is a schematic top plan view of another example of a mask which can be employed in the imaging system shown in FIGS. 1 and 2.

FIG. 20 is a schematic illustration of a mask 174 which can be employed in an imaging apparatus 100 which includes detector pixel array 170 shown in FIG. 19. The apertures 176 of the mask 174 are arranged in a staggered fashion along the x direction, and D1=3(d6).

Figure 21B:
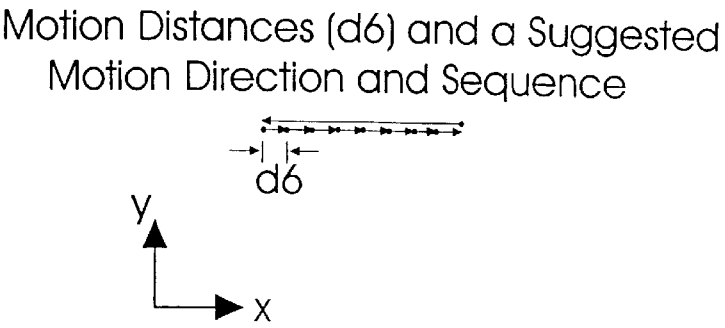
FIG. 21*b* is a diagram illustrating an exemplary sequence of movements of the detector pixel array shown in FIG. 19 and the mask shown in FIG. 20 of the imaging apparatus shown in FIGS. 1 and 2 with respect to the object being imaged according to an embodiment of the present invention.
Figure 21A:
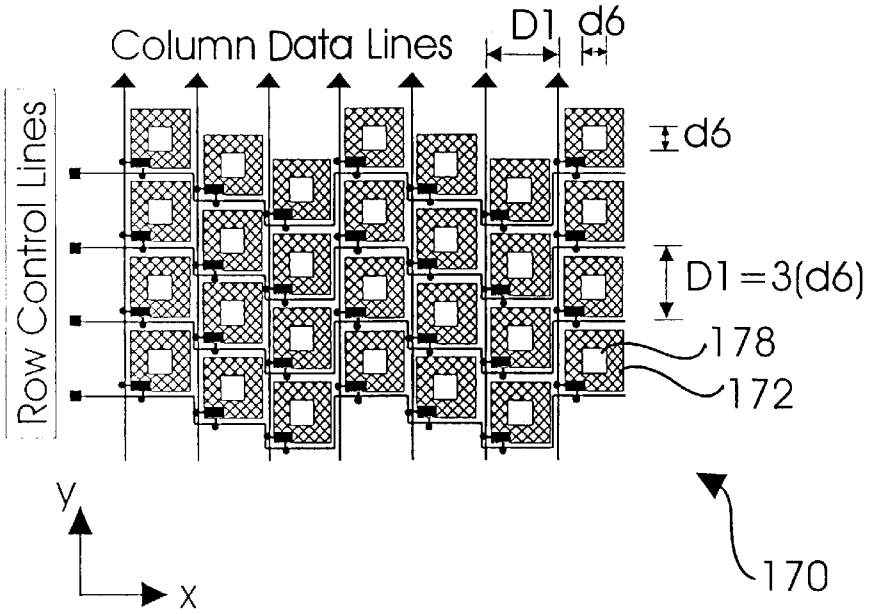
FIG. 21*a* is a schematic illustration showing the pattern of electromagnetic radiation which passes through the mask shown in FIG. 20 and strikes the scintillator adjacent the active area of the detector pixels of the detector pixel array shown in FIG. 19.

FIG. 21*a* is a schematic illustration of the positions at which the radiation beamlets 178 which pass through the aperture of the x-ray mask 174 overlaying the detector pixel array 170 strike the detector pixels 172 of the grid 170. FIG. 21*b* is a diagram of an example of the manner in which the detector pixel array 170 and mask 174 are moved for nine exposures by a distance d6 between exposures and returning to its original position. As can be appreciated from FIG. 21*b,* the staggered formation of the detector pixels grid 170 and mask 174 enable the entire object to be imaged by moving the grid 170 and mask 174 in one direction (i.e., the x direction), as opposed to in the x and y directions as from a non-staggered grid discussed above.

Another mask variation is that the apertures are not squares. For some applications, other x-ray aperature shapes might be more appropriate.

Although only several examples of masks and detector pixel array arrangements are described above, various types of mask having various apertures patterns can be used in the imaging system 100 to provide a wide variety of possible image system configurations. Also, as discussed below, the masks need not be attached to the scintillator, but rather, could be positioned at any appropriate location between the x-ray or gamma ray source and the detector pixel array.

Figure 22:
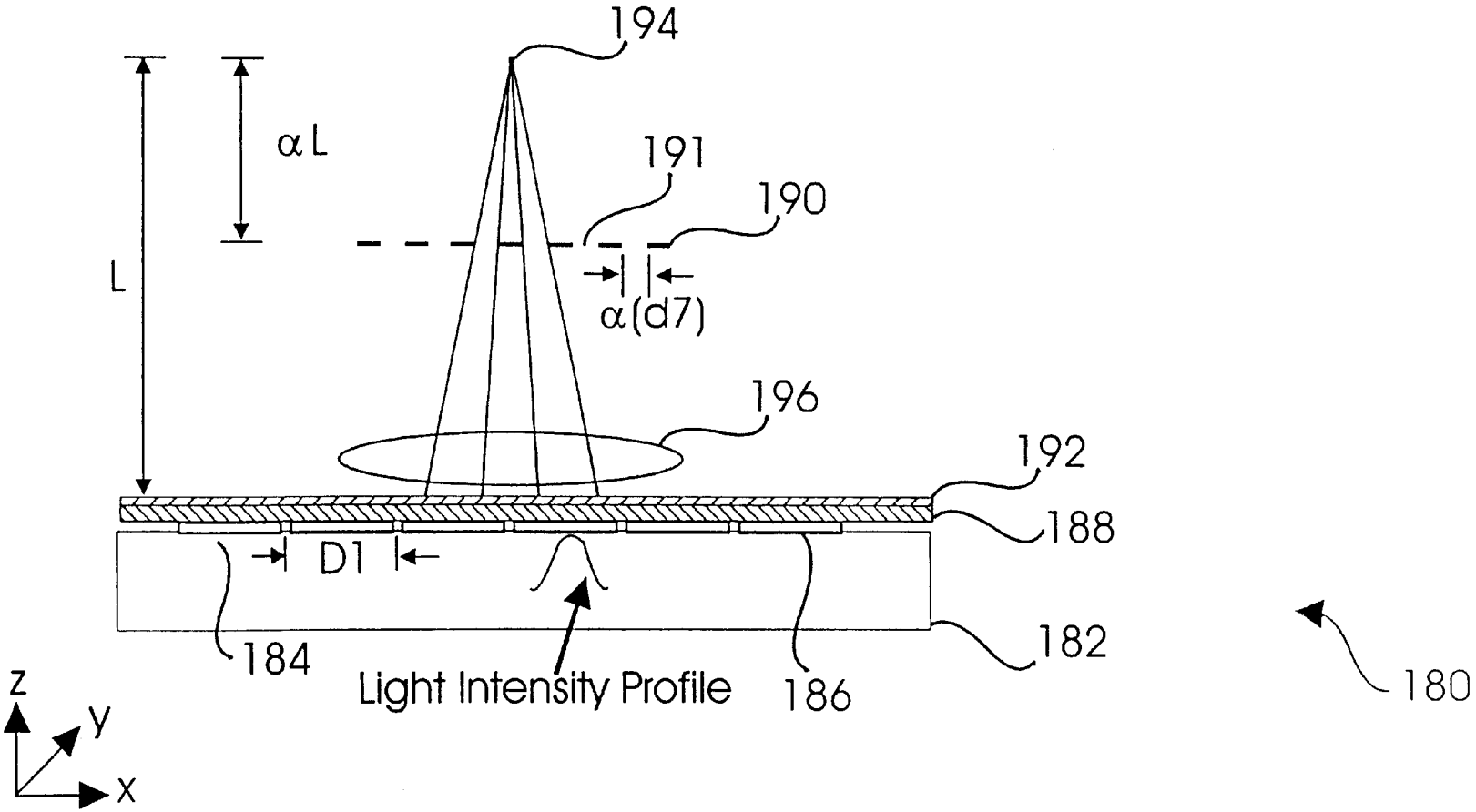
FIG. 22 is a schematic illustration of a high-resolution x-ray or gamma ray imaging apparatus according to another embodiment of the present invention in relation to an object being imaged and a point x-ray or gamma ray source.

For example, FIG. 22 is a schematic illustrating an embodiment of an imaging apparatus 180 which includes a substrate 182, a detector pixel array 184 including detector pixels 186, a scintillator 188, and a mask 190 having apertures 191 therein similar to those described above. The imaging apparatus 180 can also include an antiscatter grid 192 which is disposed over the scintillator as shown. An example of an antiscatter grid is disclosed in related copending U.S. patent application Ser. No. 08/879,258, cited above. An x-ray source 194 and object 196 being imaged are also illustrated in relation to the apparatus 180.

Unlike imaging apparatus 100, in this embodiment the object to be imaged 196 is positioned between x-ray mask 190 and the detector pixel array 184. As shown, the x-ray energy propagates out of a point x-ray source in a cone shape.

Figure 23A:
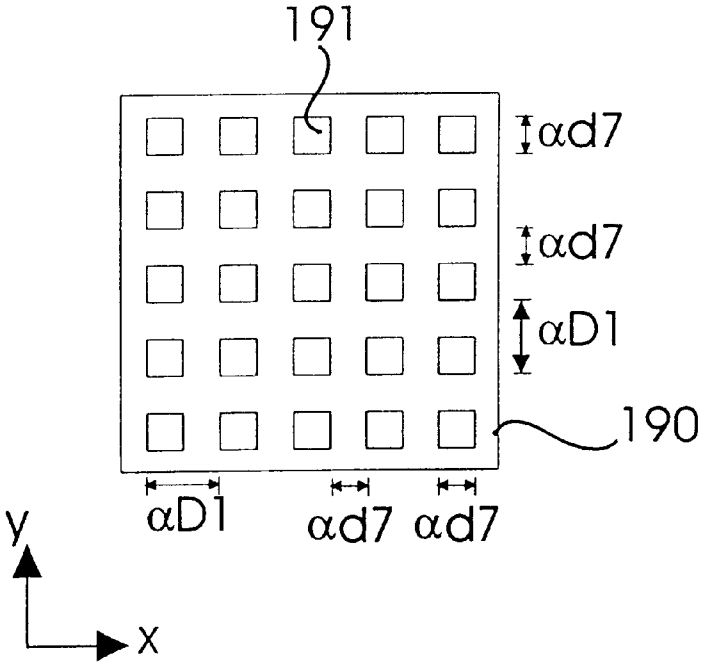
FIG. 23*a* is a schematic top plan view of an example of a mask which can be employed in the imaging system shown in FIG. 22.

FIG. 23*a* shows the mask 190 as viewed in the x-y plane. The apertures 191 are shown as having a square shape, but could have any suitable shape as discussed above for the other masks configurations. Primarily, the size and arrangement of the apertures 191 on the mask 190 should be such that they permit uniform sized and equally spaced beamlets to form on the detector pixels 186.

The periodicity of the square digital detector pixels is defined to be D1×D1. The dimension of each x-ray beamlet as it hits the detector pixel (the "x-ray spot size") is equal to d7×d7, where d7<D. Using Euclidean geometry, if the x-ray source 194 is considered to be a vertex of a triangle, the x-ray beamlet on the detector pixels 186 is the base of the triangle, and the distance between the x-ray source 194 and the detector pixel is L (distance measured orthogonally), then if the x-ray mask 190 is placed a distance $\alpha$L from the x-ray source where $\alpha$ is a fraction less than 1, the dimensions of the apertures 191 in the x-ray mask 190 must be equal to $\alpha$(d7)×$\alpha$(d7). Also, as with the variations discussed above, the apertures of the mask and the detector pixels can vary in size and shape depending on the need.

The operation of the imaging apparatus 180 will now be described. When the x-ray source 194 emits a pulse of x-ray energy which strikes the x-ray mask 190, the mask blocks all of the x-rays from striking the object except at the mask apertures 191. The x-ray beamlets which pass through the apertures of the mask penetrate the object 196 and propagate toward the antiscatter grid 192. The antiscatter grid 192 eliminates the scattered radiation, so that only the primary radiation impacts the scintillator 188. As in the imaging apparatus 100 shown in FIGS. 1 and 2, the scintillator 188 can be a phosphor screen, which converts the x-rays to optical radiation. A photodiode on each detector pixel coverts the optical radiation to electrical charge. Alternatively, the scintillator 188 can be of the type that converts the x-rays directly to electrical charge, such as photoconductor, photocathodes, and so on.

The geometry and dimensions of the detector pixels 186 and x-ray mask openings 191 are such that each x-ray beamlet passing through a respective aperture in the mask and a respective aperture in the antiscatter grid 192 will strike within a single detector pixel 186. Preferably, the active detector area of one pixel 186 captures the charges created by the impacting x-ray beamlet. After each exposure, the x-ray source is turned off or x-ray shutter is closed. The charges collected by the pixels 186 are then output via data lines in a manner similar to that described above for imaging apparatus 100.

Figure 23B:
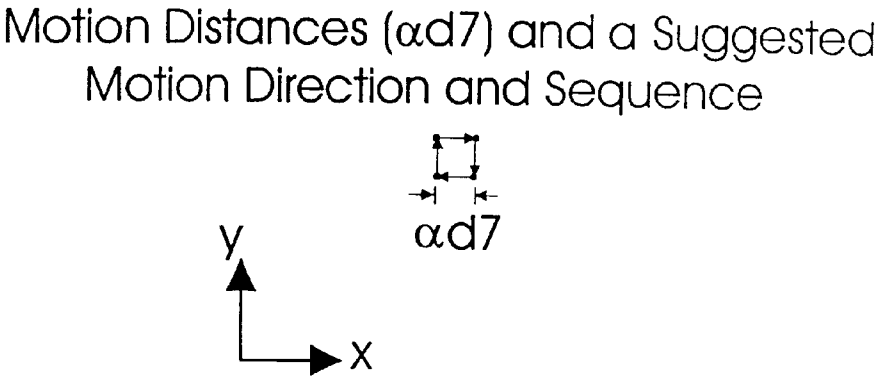
FIG. 23*b* is a diagram illustrating an exemplary sequence of movements of the mask shown in FIG. 23*a* of the imaging apparatus shown in FIG. 22 with respect to the object being imaged according to an embodiment of the present invention.

For this example, n=D1/d7=2. After one exposure and data read out, the detector grid 184 (and hence the substrate 182, scintillator 188 and antiscatter grid 192) is moved a distance D1/2 for n=2 in a sequence as shown in FIG. 12*b* and the x-ray mask 190 is moved by a distance $\alpha$d7 in the same sequence as shown in FIG. 23*b* while the object 196 (patient) remains stationary, to expose a different portion of the object 196. This process is repeated $n^2$times with the detector and mask moved in unison so that every part of the object will be imaged. After all the necessary sub-images have been output and stored, the data is processed to produce one image in a manner similar to that described above. Even though $n^2$ exposures are taken, the tissue is exposed to the same dose of x-ray as in one exposure without the mask, because each exposure is $1/n^2$ the area of an exposure without the mask. The data is then reconstructed digitally to produce the high-resolution image.

Variations of the embodiments for the mask and the detector grid layout are the same as those exemplified in FIGS. 8 through 21, except that each aperture of the mask is reduced in size by the factor a and the motion of the mask is reduced by the same factor.

Figure 24B:
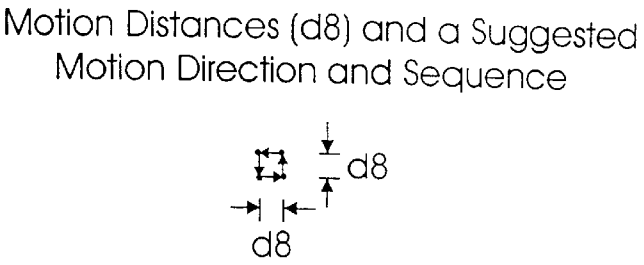
FIG. 24*b* is a diagram illustrating an exemplary pattern of movement of the x-ray source of the apparatus shown in FIG. 24*a* with respect to the object being imaged according to an embodiment of the present invention.
Figure 24A:
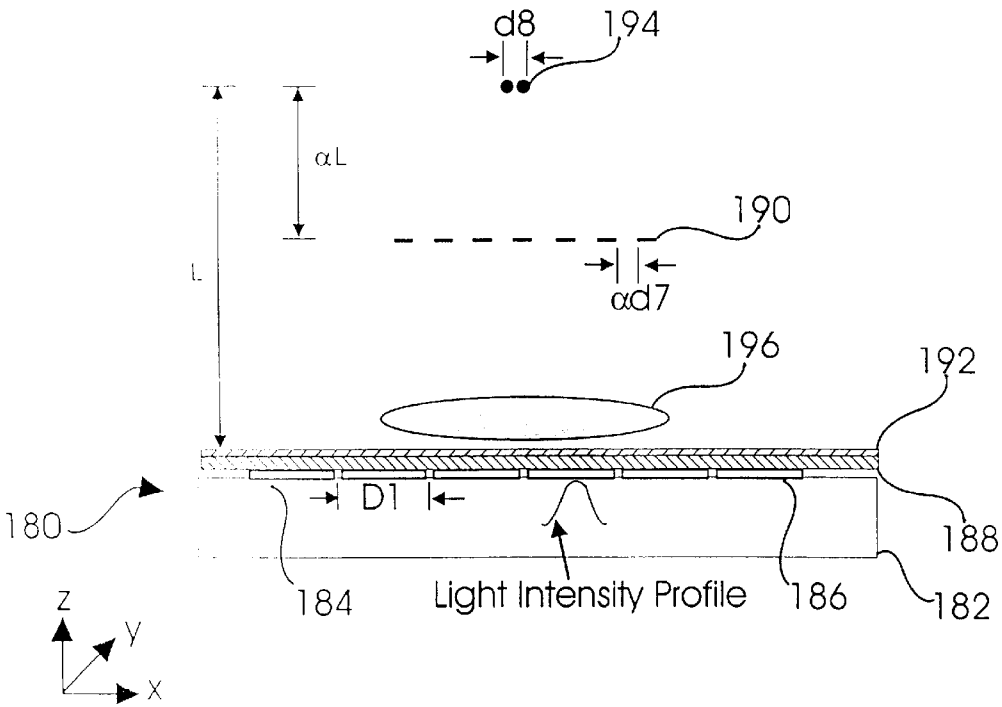
FIG. 24*a* is a schematic illustration of a high-resolution x-ray or gamma ray imaging apparatus according to another embodiment of the present invention in relation to an object being imaged and a point x-ray or gamma ray source.

FIG. 24*a* is a schematic diagram illustrating that the image filtering concept can be obtained by moving the location of the x-ray source 194 without moving the mask 190. For the detector shown in FIG. 6 and D1/d7=n=2, the detector motion is shown in FIG. 12*b,* the corresponding x-ray source displacement is shown in FIG. 24*b,* where the distance between displacement is d8 and d8≈(D1/n)($\alpha$/(1−$\alpha$)). The direction of motion for the source, shown in FIG. 24*b,* is opposite to the direction of motion for the detector, shown in FIG. 12*b*. The range for $\alpha$ is between 0 and 1, and the optimal values for a are near 0.5. The positions for the x-ray source 194 are such that every part of the object will be imaged. Variations of the embodiments for the mask and the detector grid layout are the same as those exemplified in FIGS. 8 through 21, except that each aperture is reduced in size by the factor $\alpha$.

Another variation of FIG. 24*a* is to move the location of the x-ray source 194 and the x-ray mask 190, but not move the detector 184, the scintillator 188 or the antiscatter grid 192.

As discussed above, the x-ray mask 190 should be made of high atomic number materials 191 on x-ray transparent substrate 192, so that the x-rays can be substantially completely blocked with even a thin mask. The desirable thickness will dependent on the allowable transmitted x-rays and the x-ray energy. Gold is most commonly used as x-ray lithography masks. The attenuation factor of gold over the density, $\mu/\rho$, varies with x-ray energy. For example, at x-ray energy of 22.16 keV, $\mu/\rho$=59.7 $cm^2/g$ and at x-ray energy of 30 keV, $\mu/\rho$=25.55 $cm^2/g$, where $\rho$=19.3 g/cm3 is the density of gold. The amount of x-ray that penetrates the mask is equal to exp(−$\mu$L), where L is the thickness of the mask. Typically gold masks of can produce apertures with dimensions of 75 $\mu$m to 100 $\mu$m and vertical walls are routinely used to block x-rays in the 5–20 keV range. The mask needs to be thicker as the x-ray energy increases. The aperture walls of the mask should ideally be slanted along the direction at which the x-rays are received. If the x-ray source is from a point, then the mask should have the configuration shown schematically in FIGS. 25*a,* 25*b* or 25*c,* in which the slant angles increase with distance from the center of the mask. The top layer of the mask in FIG. 25*c* does not have to have the same thickness as the bottom layer.

Figures 25A, 25B, 25C, 25D, 25E:
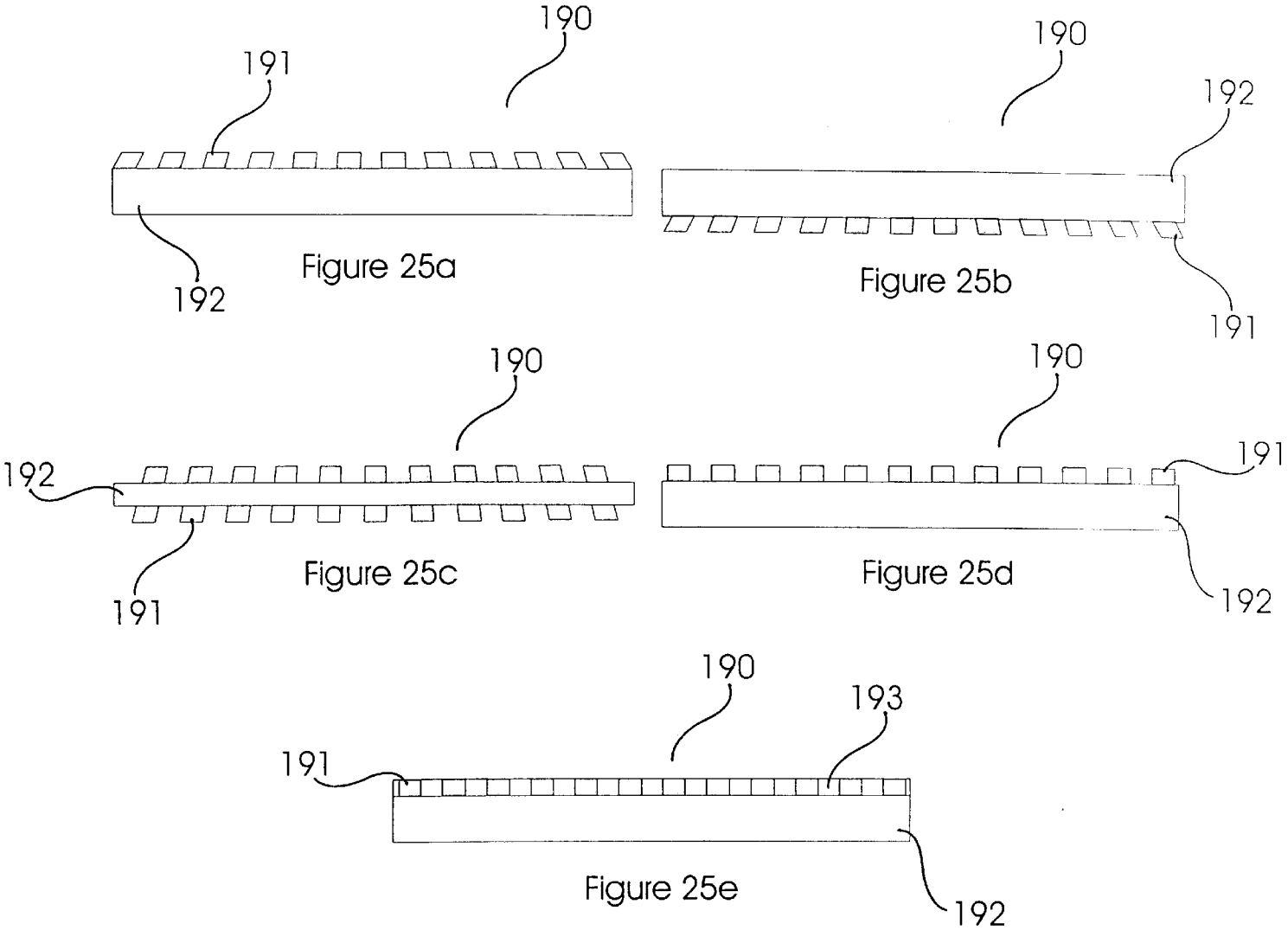
FIGS. 25*a*, 25*b* and 25*c* are schematic cross-sectional views of examples of masks which can be employed in an imaging apparatus as shown in FIGS. 1, 2, 22, 24*a*, 26, 27 or 28, when the imaging apparatus is used with a point x-ray source.
FIGS. 25*d* and 25*e* are schematic cross-sectional views of examples of masks which can be employed in an imaging apparatus as shown in FIGS. 1, 22, 27 or 28, when the imaging apparatus is used with a parallel beam x-ray source.

On the other hand, if the x-ray source is a parallel beam, the mask should have a configuration like that shown schematically in FIG. 25*d,* in which the aperture walls are all substantially vertical. The photoresist used in making the x-ray mask 193 does not have to be removed if it is x-ray transparent material, as shown in FIG. 25*e.* This is also true for a mask focused to a point x-ray source.

In an imaging apparatus 100 as shown in FIGS. 1 and 2, x-ray scatter can be reduced if the mask is thick and configured as an antiscatter grid. However, in the imaging apparatus 180 as shown in FIG. 22, x-ray scatter can be reduced even without the use of an antiscatter grid.

Figure 26:
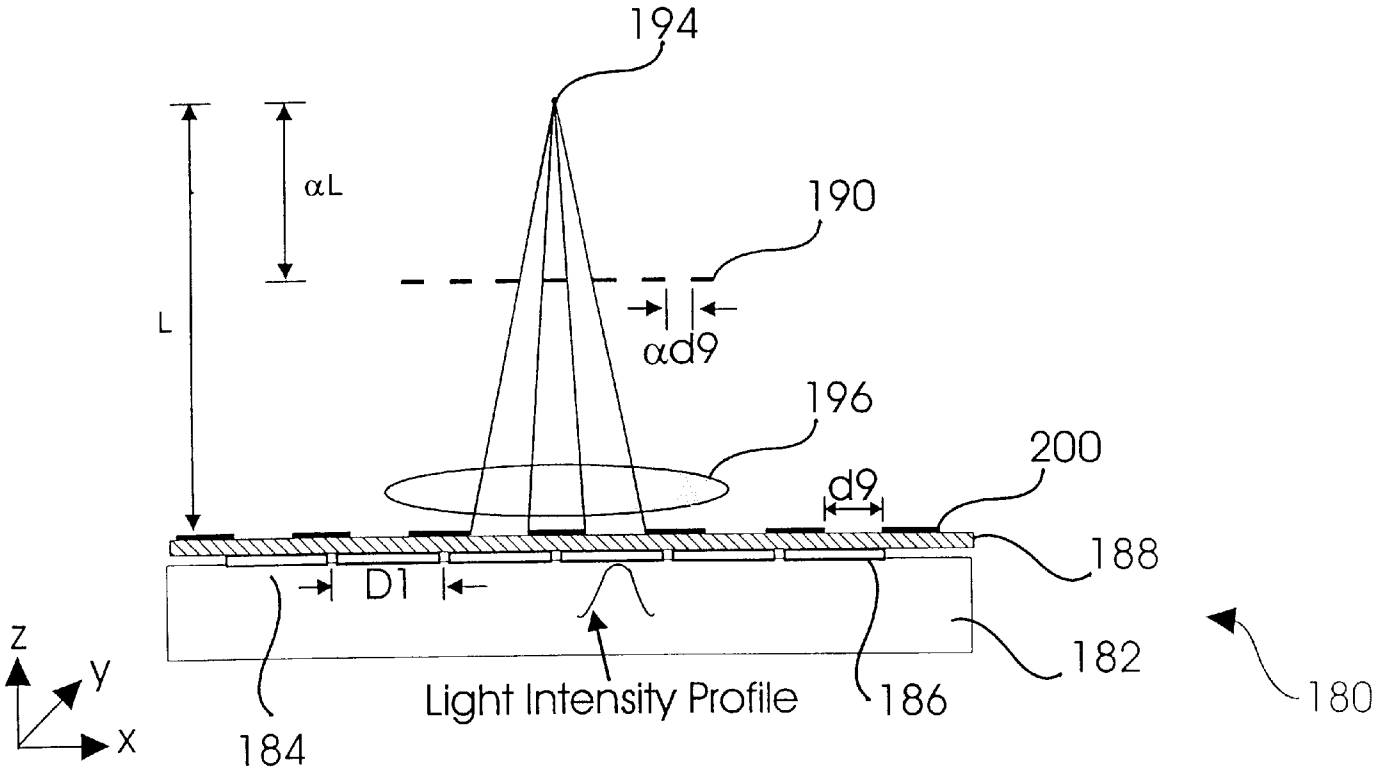
FIG. 26 is a schematic illustration of a high-resolution x-ray or gamma ray imaging apparatus according to another embodiment of the present invention in relation to an object being imaged and a point x-ray or gamma ray source.

That is, when the x-ray sensitive area $\epsilon$ of the detector pixels is small compared to the area associated with the detector pitch E, the scatter is reduced by approximately the ratio $\epsilon$/E. Alternatively, a thin mask 200 with aperture d9×d9 can be used in the imaging apparatus 180 in place of the antiscatter grid 192, as shown schematically in FIG. 26, to reduce x-ray scatter by the ratio of $(d9/D1)^2$.

Figure 27:
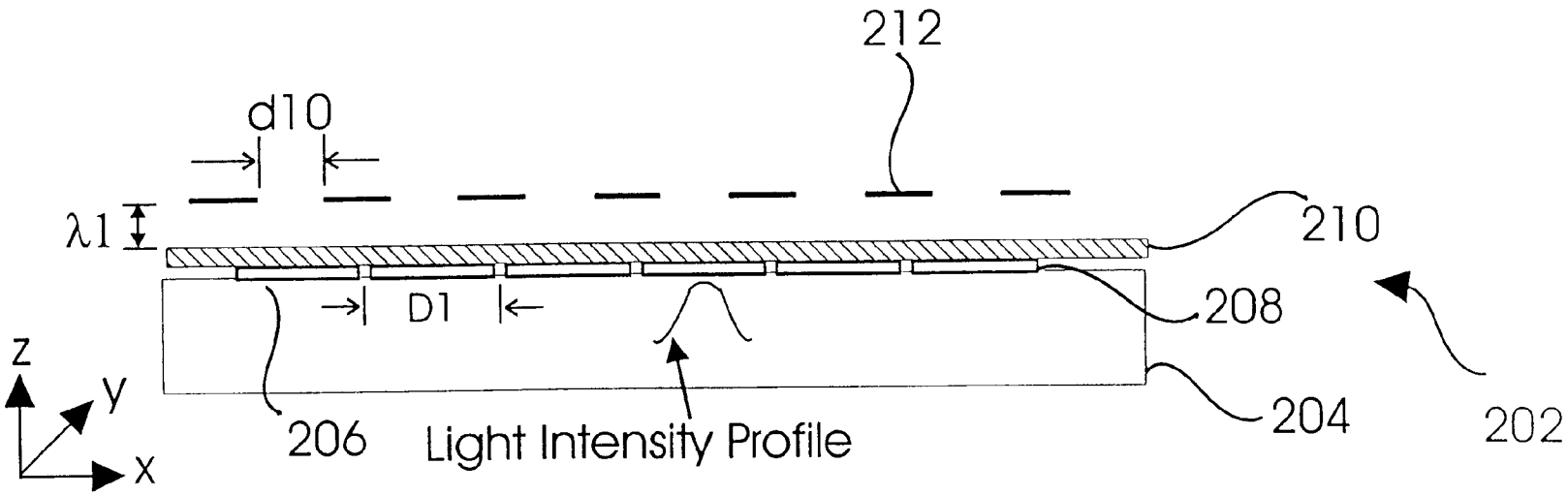
FIG. 27 is a schematic illustration of a high-resolution x-ray or gamma ray imaging apparatus according to a further embodiment of the present invention in relation to an object being imaged and a point x-ray or gamma ray source.
Figure 28:
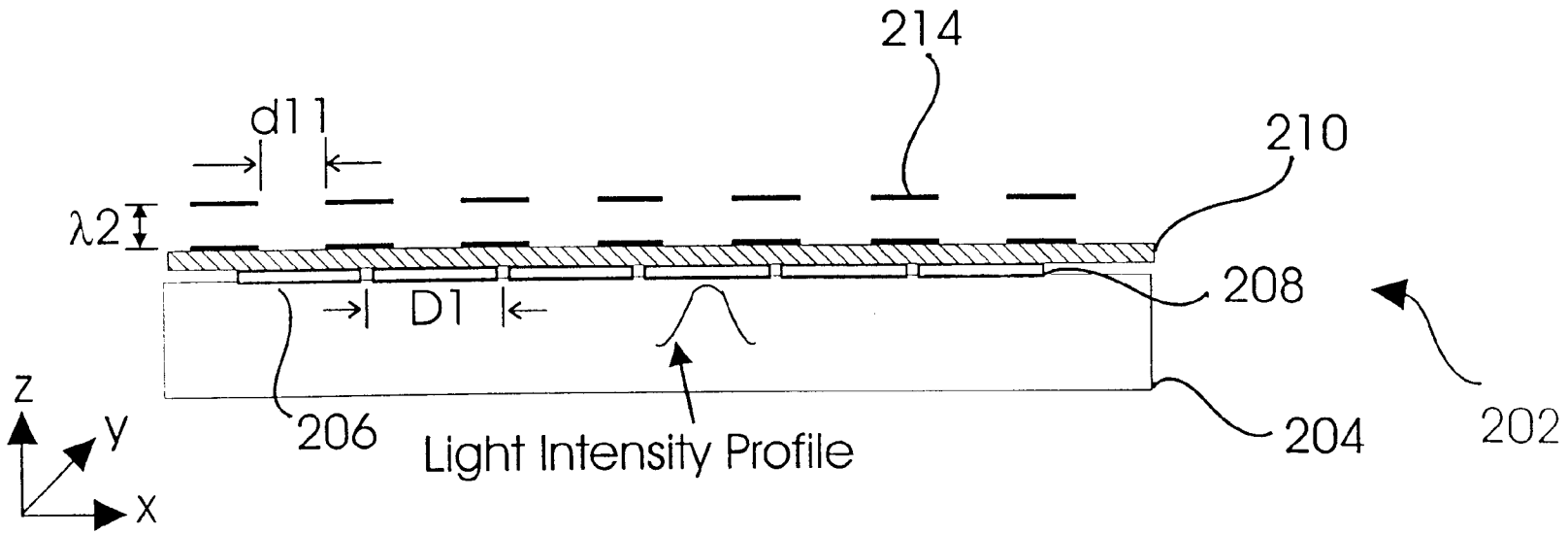
FIG. 28 is a schematic illustration of a high-resolution x-ray or gamma ray imaging apparatus according to still another embodiment of the present invention in relation to an object being imaged and a point x-ray or gamma ray source.

FIG. 27 is a schematic illustration of another embodiment of an imaging apparatus according to the present invention. Imaging apparatus 202 includes a substrate 204, a digital detector pixel array 206 comprising detector pixels 208, a scintillator 210, and an x-ray mask 212 having apertures d10×d10. However, in this embodiment, the mask is placed a distance $\lambda$1 above the scintillator, and the object (not shown) to be imaged is placed above the x-ray mask 212. The mask wall thickness and the distance x can act as an antiscatter grid. Alternatively, a properly aligned double mask 214, having apertures d11×d11 and individual mask portions separated by an appropriate distance $\lambda$2, can be used to reduce scatter as shown schematically in FIG. 28.

Figure 29:
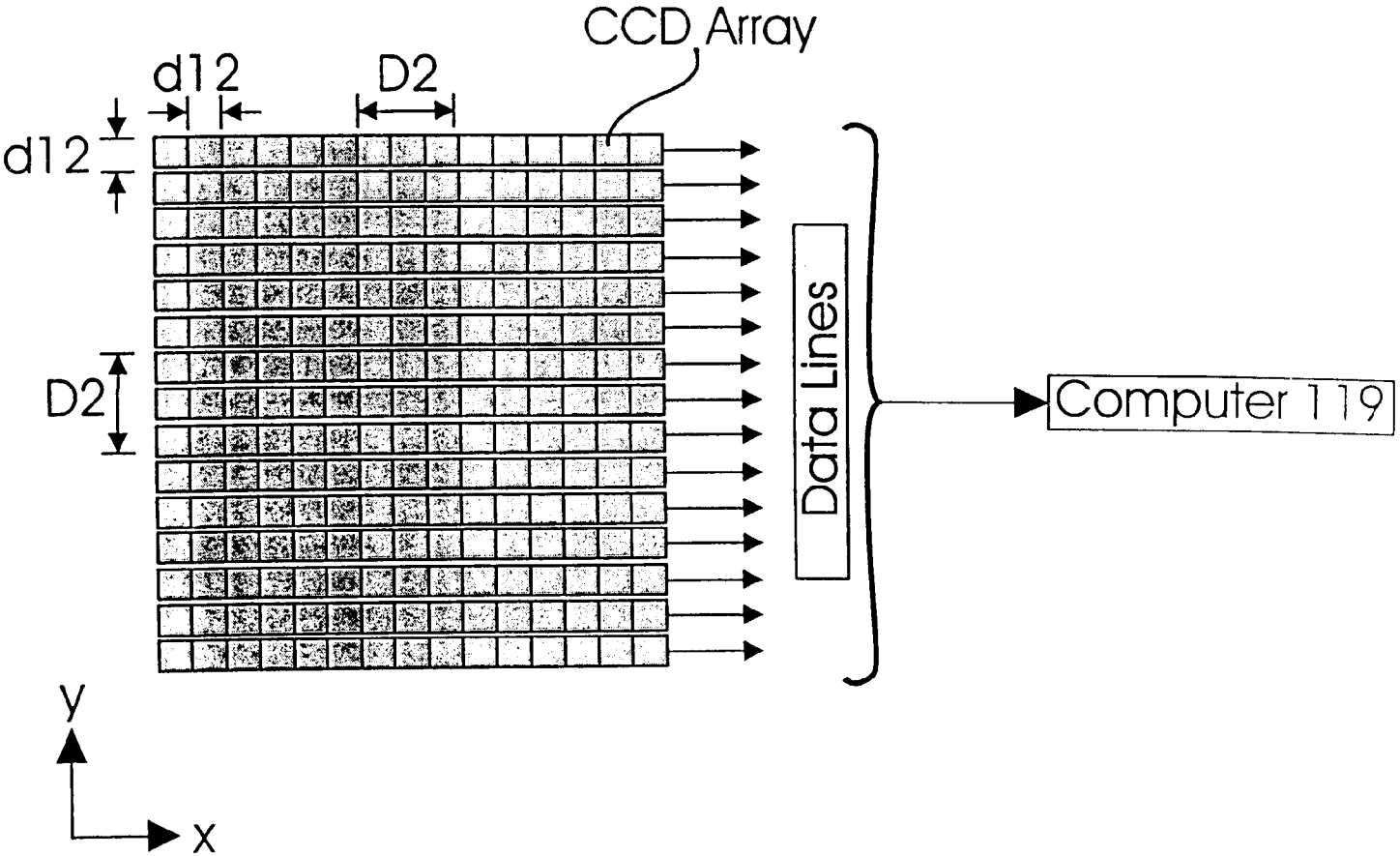
FIG. 29 is a schematic illustration of a detector array such as a charge coupled device (CCD)

The invention as described with regard to FIGS. 1–28 employs a detector having a detector pixel pitch that is larger than the x-ray mask opening. The following embodiment of the invention employs detectors that have small pixels to obtain high-resolution images. A schematic of a CCD is shown in FIG. 29. The pixel sizes of the CCD can have dimensions d12×d12, with d12 being less than 10 $\mu$m. However the resolution of the conventional x-ray image is degraded by the phosphor so that the small pixels of the CCD still cannot produce high-resolution images.

The concept described above is also applicable to the CCD detector. A group of the CCD can be configured together to collect data for one x-ray image pixel, where d12 is the pixel pitch of the CCD. The CCD arrays can be used in configurations shown in FIGS. 1, 2, 22, 24, 26, 27 and 28.

Figure 30:
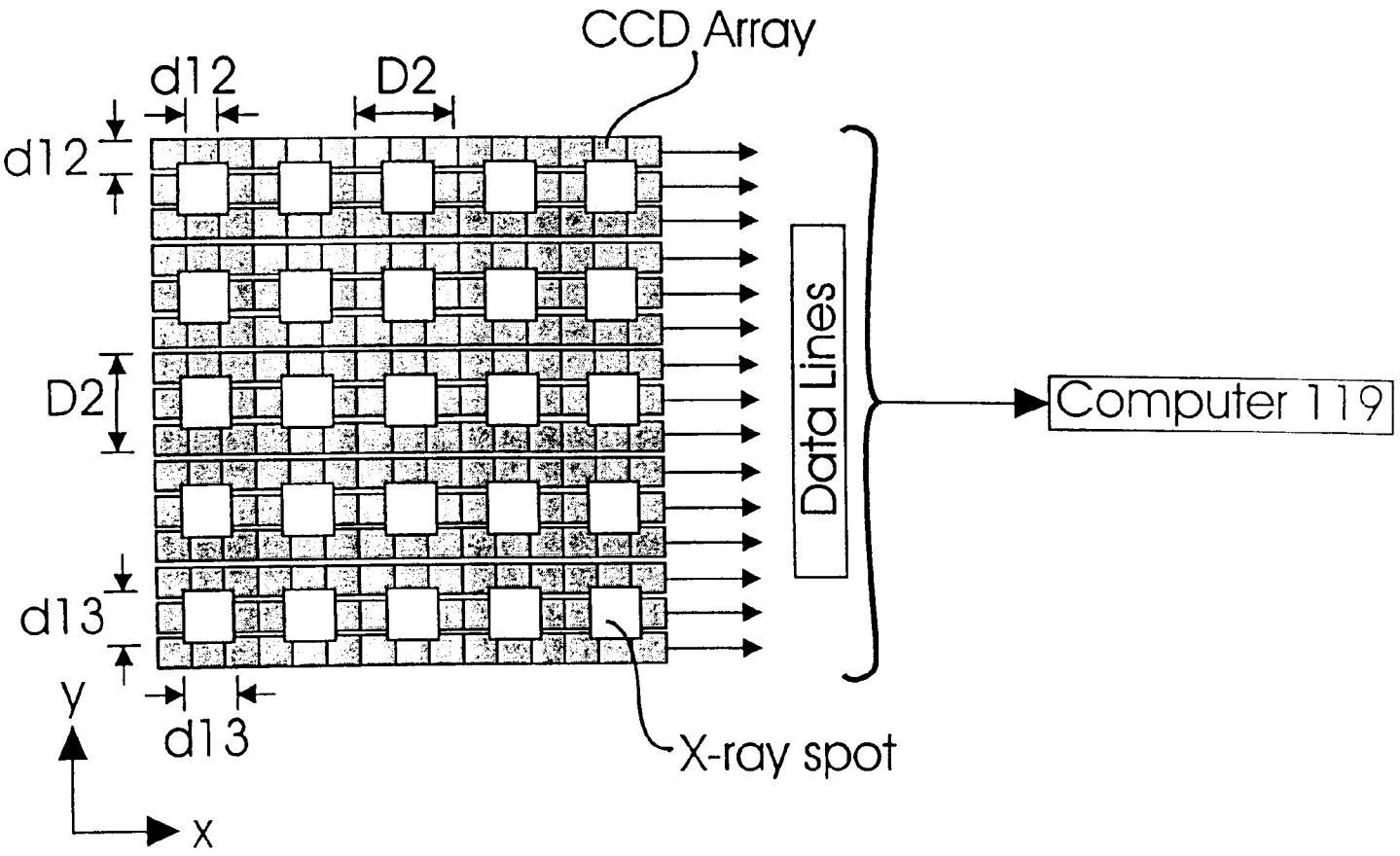
FIG. 30 is a schematic illustration showing the pattern of electromagnetic radiation which passes through the mask and strikes the scintillator adjacent the active area of the detector pixels of the detector pixel array shown in FIG. 29.

FIG. 30 is a schematic illustration showing the pattern of x-rays which passes through the mask overlaying the active area of the detector pixels of the detector pixel array shown in FIG. 29. The example shown in FIG. 30 utilizes 3×3 CCD pixels to collect the information relating to x-ray intensity for one x-ray image pixel, i.e., 3(d12)=D2, and d13 is the x-ray spot size overlapping the CCD.

The signal collected by each group of CCD pixels with dimension D2×D2 under an x-ray beamlet will be grouped together to form the signal for the x-ray beamlet. Each D2×D2 group of pixels is effectively a macro pixel analogous to a single pixel of D1×D1 as shown, for example, in FIG. 6. For illustration purposes, nine CCD pixels form a macro pixel in FIG. 30.

If the CCD pixels are much smaller than D2, then slight misalignment of the CCD array with respect to the mask can be tolerated by redistributing the signal of the CCD pixel to different macro pixels using software algorithms. The amount of misalignment may be on the order d11 over a distance of tens of D2.

When CCD detectors are used and d13/d12 is greater than or equal to one, only the mask, and not the detector, needs to move for configurations shown in FIGS. 1, 2, 22, 27 and 28. Neither the mask nor the detector are required to move for the configuration shown in FIG. 24*a*.

The high-resolution x-ray imaging apparatus discussed above according to the present invention has many applications. In addition to medical applications (e.g., mammography), such imaging apparatus can be used in scientific research, defense and security environments, biotechnology, x-ray microscopy, x-ray astronomy, three-dimensional x-ray tomography and various industrial applications such as those in which non-destructive testing is required.

For example, radiographic testing is used in industry in process control to detect manufacturing flaws and is increasingly integrated as a crucial component on the manufacturing floor. The trend of non-destructive testing is moving toward the use of real-time, non-film radioscopic systems over traditional film-based systems. Digital non-destructive evaluation offers all the traditional benefits of detecting microscopic flaws and providing permanent inspection records. It enables new capabilities such as computer-based inspection methods and cost reduction. The electronics and automotive industries have moved fastest to adopt radioscopy; many other industries are following this trend.

The spatial filtering which is performed by the present invention to obtain high-resolution digital x-ray or gamma ray images provides several advantages. The imaging apparatus can use either direct or indirect x-ray or gamma ray conversion to generate signals representative of the image. The invention provides an improvement of the MTF beyond the limitation of the pixel pitch of the detector pixel array. Image degradation by conversion blurring caused by phosphor screens can be minimized, and image degradation by oblique x-ray incidence can be minimized, thus providing improved image resolution as well as more spatially uniform image resolution. In medical applications, the method and apparatus of the present invention also allow for x-ray detection efficiency beyond the limitation of the fill factor of the imager, without the need for increasing the x-ray or gamma ray dosage to a patient.

In addition, a wide range of image resolutions can be achieved using the present invention, with digital x-ray or gamma ray images having a resolution as small as 1 $\mu$m. This concept of using mask to select the resolution is independent of the dimensions. Typically, the pixel size of gamma cameras are large while the pixel size of the CCDs are typically small. The pixel size depends on the energy of the radiation to be detected, the application and availability of detectors. Similarly, the mask thickness and the aperature size depends on the application's needs, the x-ray energy and the ability to fabricate the aperture size with the appropriate mask thickness.

Although only a limited number of exemplary embodiments of the invention have been described in detail above, those skilled in the art will readily appreciate that many modifications are possible in the exemplary embodiments without materially departing from the novel teachings and advantages of this invention. Accordingly, all such modifications are intended to be included within the scope of the invention as defined in the following claims.

What is claimed is:

1. An apparatus for obtaining a digital image of an object or objects being irradiated with radiation having a wavelength in the x-ray or gamma ray spectrum generated by a radiation source, comprising:

a detector matrix, comprising a plurality of detector pixels, arranged such that the centers of each adjacent detector pixels are spaced at a first pixel pitch distance from each other in a direction along the width of said detector matrix, and at a second pixel pitch distance from each other in a direction along the length of said detector matrix, with each detector pixel comprising a detection surface having a respective surface area and being adapted to generate a signal in response to an energy stimulus applied thereto; and at least one radiation mask having an opaque portion and a plurality of apertures therein, arranged such that the centers of each adjacent apertures are spaced at a first aperture pitch distance from each other in a direction along the width of said radiation mask, and at a second aperture pitch distance from each other in a direction along the length of said radiation mask, said first and second aperture pitch distances being smaller than said first and second pixel pitch distances, respectively, said radiation mask being positioned between the radiation source and the object or objects, such that said opaque portion substantially prevents portions of said radiation from passing therethrough, and each of said apertures permits a portion of said radiation that has passed through to strike at least a portion of said detection surface of a respective one of said detector pixels, so that said detector pixels each output a respective signal representative of an image of said respective portion of said object.

2. An apparatus as claimed in claim 1, wherein:

each of said apertures permits a respective said portion of said radiation that has passed therethrough to strike an area of said detection surface, less than said surface area, of a respective one of said detector pixels.

3. An apparatus as claimed in claim 1, wherein:

each of said apertures permits a respective said portion of said radiation that has passed therethrough to strike portions of a plurality of said detection surfaces of a respective plurality of said detector pixels.

4. An apparatus as claimed in claim 1, further comprising:

an image creating device which arranges said images of said respective portions of said object to form the digital image of said object.

5. An apparatus as claimed in claim 1, further comprising:

a conveying device which moves said detector matrix and radiation mask in relation to said object to enable said areas of said detection surfaces of said detector pixels to receive portions of said radiation propagating through or emitted from other portions of said object and to output signals representative of said other portions.

6. An apparatus as claimed in claim 1, wherein:

said detector pixels are arranged in said detector matrix in a plurality of detector rows, each row comprising a first number of said detector pixels, and a plurality of detector columns, each column comprising a second number of said detector pixels, said detector pixels in each of said detector rows being separated by said first pixel pitch distance, and said detector pixels in each of said detector columns being separated by said second pixel pitch distance; and said apertures in said radiation mask are arranged in a plurality of aperture rows, each comprising a first number of apertures, and a plurality of aperture columns, each comprising a second number of said apertures.

7. An apparatus as claimed in claim 6, further comprising:

a conveying device which is adapted to move said detector matrix and said detector mask in relation to said object by a first distance equal to a fraction of said first pixel pitch distance in a first direction substantially parallel to said detector rows, and which is adapted to move said detector matrix and said detector mask in relation to said object by a second distance equal to a fraction of said second pixel pitch distance in a second direction substantially parallel to said detector columns.

8. An apparatus as claimed in claim 7, wherein:

said conveying device moves said detector matrix and said detector mask incrementally in said first direction until said detector matrix and said detector mask have moved said first distance; and said conveying device moves said detector matrix and said detector mask incrementally in said second direction until said detector matrix and said detector mask have moved said second distance.

9. An apparatus as claimed in claim 7, wherein:

said conveying device moves said detector matrix and said detector mask incrementally in said first direction until said detector matrix and said detector mask have moved said first distance.

10. An apparatus as claimed in claim 7, wherein:

said conveying device moves said detector matrix and said detector mask incrementally in said second direction until said detector matrix and said detector mask have moved said second distance.

11. An apparatus as claimed in claim 6, wherein:

said first number of detector pixels equals said first number of apertures; and said second number of detector pixels equals said second number of apertures.

12. An apparatus as claimed in claim 6, wherein:

said first and second pixel pitch distances are equal.

13. An apparatus as claimed in claim 6, wherein:

said first and second pixel pitch distances are different from each other.

14. An apparatus as claimed in claim 1, wherein:

said detection surfaces of said detector pixels are each substantially square in shape;

and said apertures are each substantially square in shape.

15. An apparatus as claimed in claim 1, wherein:

each of said apertures occupies an area less than said surface area of a respective one of said detector pixels.

16. An apparatus as claimed in claim 1, further comprising:

a plurality of said radiation masks.

17. An apparatus as claimed in claim 1, wherein:

said radiation mask comprises a focused radiation mask.

18. An apparatus as claimed in claim 1, wherein:

said radiation mask is an unfocused radiation mask.

19. An apparatus as claimed in claim 1, wherein:

said detection surfaces of said detector pixels are each substantially rectangular in shape;

and said apertures are each substantially square in shape.

20. An apparatus as claimed in claim 1, wherein:

said detection surfaces of said detector pixels are each substantially square in shape;

and said apertures are each substantially rectangular in shape.

21. An apparatus as claimed in claim 1, wherein:

said opaque portion of said radiation mask is configured to form first walls of said radiation mask extending substantially parallel to each other along a first direction and second walls of said radiation mask extending substantially parallel to each other along a second direction.

22. An apparatus as claimed in claim 1, wherein:

said opaque portion of said radiation mask is configured to form first walls and second walls of said radiation mask extending along first and second directions, respectively, such that at least one of said first and second walls are angled to focus to a point at a distance from said radiation mask.

23. An apparatus as claimed in claim 1, further comprising:

an imager which arranges said images of said respective portions of said object to form the digital image of said object.

24. A method for using a detector matrix comprising a plurality of detector pixels to obtain a digital image of an object or objects the detector pixels being arranged such that the centers of each adjacent detector pixels are spaced at a first pixel pitch distance from each other in a direction along the width of said detector matrix, and at a second pixel pitch distance from each other in a direction along the length of said detector matrix, the method comprising the steps of:

emitting from a radiation source radiation having a wavelength in the x-ray or gamma ray spectrum generated in a direction toward said object or objects; and positioning at least one radiation mask having an opaque portion and a plurality of apertures therein between said radiation source and said object or objects, said radiation mask being configured such that the centers of each adjacent apertures are spaced at a first aperture pitch distance from each other in a direction along the width of said radiation mask, and at a second aperture pitch distance from each other in a direction along the length of said radiation mask, said first and second aperture pitch distances being smaller than said first and second pixel pitch distances, said opaque portion substantially preventing first portions of said radiation from passing therethrough, and each of said apertures permitting a respective second portion of said radiation that has passed through to strike at least a portion of said detection surface of a respective one of said detector pixels, so that said detector pixels each output a respective signal representative of an image of said respective portion of said object.

25. A method as claimed in claim 24, wherein:

said apertures permit said second portions of said radiation to each propagate onto an area of said detection surface, less than said surface area, of a respective one of said detector pixels.

26. A method as claimed in claim 24, wherein:

said apertures permit said second portions of said radiation to strike portions of a plurality of said detection surfaces of a respective plurality of said detector pixels.

27. A method as claimed in claim 24, further comprising the step of:

arranging said images of said respective portions of said object to form the digital image of said object.

28. A method as claimed in claim 24, further comprising the steps of:

after performing said emitting and positioning steps, moving said detector matrix and radiation mask in relation to said object; and after performing said moving step, repeating said emitting and positioning steps to enable said areas of said detection surfaces of said detector pixels to receive portions of said radiation propagating through other portions of said object and to output signals representative of said other portions.

29. A method as claimed in claim 24, wherein:

said detector pixels are arranged in said detector matrix in a plurality of detector rows, each comprising a first number of said detector pixels, and a plurality of detector columns, each comprising a second number of said detector pixels, said detector pixels in each of said detector rows being separated by said first pixel pitch distance, and said detector pixels in each of said detector columns being separated by said second pixel pitch distance; and said apertures in said radiation mask are arranged in a plurality of aperture rows, each comprising a first number of apertures, and a plurality of aperture columns, each comprising a second number of said apertures; and wherein said method further comprises at least one of the following steps:

after performing said emitting and positioning steps, performing a first step of moving said detector matrix and said detector mask in relation to said object by a first distance equal to a fraction of said first pixel pitch distance in a first direction substantially parallel to said detector rows, and repeating said emitting step to enable said areas of said detection surfaces of said detector pixels to receive portions of said radiation propagating through other portions of said object and to output signals representative of said other portions; and after repeating said emitting step, performing a second step of moving said detector matrix and said detector mask in relation to said object by a second distance equal to a fraction of said second pixel pitch distance in a second direction substantially parallel to said detector rows, and repeating said emitting step to enable said areas of said detection surfaces of said detector pixels to receive portions of said radiation propagating through from further other portions of said object and to output signals representative of said further other portions.

30. A method as claimed in claim 29, wherein:

said second step is performed after said first step has been performed.

31. A method as claimed in claim 29, wherein:

said second step is performed before said first step has been performed.

32. A method as claimed in claim 29, wherein:

during said first step, said detector matrix and said radiation mask are moved incrementally in said first direction, and said emitting step is repeated after each incremental movement, until said detector matrix and said radiation mask have moved said first distance; and during said second step, said detector matrix and said radiation mask are moved in synchronism incrementally in said second direction, and said emitting step is repeated after each incremental movement, until said detector matrix and said radiation mask have moved said second distance.

33. A method as claimed in claim 32, wherein:

said first and second steps are repeated until said detector pixels have output signals representative of an entirety of said object.

34. A method as claimed in claim 24, further comprising the steps of:

after performing said emitting and positioning steps, moving said radiation source in relation to said object; and after performing said moving step, repeating said emitting step to enable said areas of said detection surfaces of said detector pixels to receive portions of said radiation propagating through other portions of said object and to output signals representative of said other portions.

35. A method as claimed in claim 24, wherein:

said radiation mask focuses said second portions of said radiation toward said detector pixels.

36. A method as claimed in claim 24, wherein:

said radiation mask permits said second portions of said radiation to propagate unfocused toward said detector pixels.

37. An apparatus for obtaining a digital image of an object or objects being irradiated with radiation having a wavelength in the x-ray or gamma ray spectrum generated by a radiation source, or of an object or objects emitting radiation within the x-ray or gamma ray spectrum, comprising:

a detector matrix, comprising a plurality of detector pixels, each detector pixel comprising a detection surface having a respective surface area and being adapted to generate a signal in response to an energy stimulus applied thereto; and at least one radiation mask having an opaque portion and a plurality of apertures therein, said radiation mask being positioned between the detector matrix and the object or objects, such that said opaque portion substantially prevents portions of said radiation from passing therethrough, and each of said apertures permits a portion of said radiation that has passed through or has been emitted from a respective portion of said object to pass therethrough and strike a portion of said detection surface of a respective one of said detector pixels, said portion being less than the entire said detection surface of said respective one said detector pixel, so that said detector pixels each output a respective signal representative of an image of said respective portion of said object having a resolution based on a size of a respective one of said apertures.

38. An apparatus as claimed in claim 37, wherein:

each of said apertures permits a respective said portion of said radiation that has passed therethrough to strike an area of said detection surface, less than said surface area, of a respective one of said detector pixels.

39. An apparatus as claimed in claim 37, wherein:

each of said apertures permits a respective said portion of said radiation that has passed therethrough to strike portions of a plurality of said detection surfaces of a respective plurality of said detector pixels.

40. An apparatus as claimed in claim 37, further comprising:

an imager which arranges said images of said respective portions of said object to form the digital image of said object.

41. An apparatus as claimed in claim 37, further comprising:

a conveying device which moves said detector matrix and radiation mask in relation to said object to enable said areas of said detection surfaces of said detector pixels to receive portions of said radiation propagating through or emitted from other portions of said object and to output signals representative of said other portions.

42. An apparatus as claimed in claim 37, wherein:

said detector pixels are arranged in said detector matrix in a plurality of detector rows, each row comprising a first number of said detector pixels, and a plurality of detector columns, each column comprising a second number of said detector pixels, said detector pixels in each of said detector rows being separated by a first pixel pitch distance, and said detector pixels in each of said detector columns being separated by a second pixel pitch distance; and said apertures in said radiation mask are arranged in a plurality of aperture rows, each comprising a first number of apertures, and a plurality of aperture columns, each comprising a second number of said apertures.

43. An apparatus as claimed in claim 42, further comprising:

a conveying device which is adapted to move said detector matrix and said detector mask in relation to said object by a first distance equal to a fraction of said first pixel pitch distance in a first direction substantially parallel to said detector rows, and which is adapted to move said detector matrix and said detector mask in relation to said object by a second distance equal to a fraction of said second pixel pitch distance in a second direction substantially parallel to said detector columns.

44. An apparatus as claimed in claim 43, wherein:

said conveying device moves said detector matrix and said detector mask incrementally in said first direction until said detector matrix and said detector mask have moved said first distance; and said conveying device moves said detector matrix and said detector mask incrementally in said second direction until said detector matrix and said detector mask have moved said second distance.

45. An apparatus as claimed in claim 43, wherein:

said conveying device moves said detector matrix and said detector mask incrementally in said first direction until said detector matrix and said detector mask have moved said first distance.

46. An apparatus as claimed in claim 43, wherein:

said conveying device moves said detector matrix and said detector mask incrementally in said second direction until said detector matrix and said detector mask have moved said second distance.

47. An apparatus as claimed in claim 42, wherein:

said first number of detector pixels equals said first number of apertures; and said second number of detector pixels equals said second number of apertures.

48. An apparatus as claimed in claim 42, wherein:

said first and second pixel pitch distances are equal.

49. An apparatus as claimed in claim 42, wherein:

said first and second pixel pitch distances are different from each other.

50. An apparatus as claimed in claim 37, wherein:

said detection surfaces of said detector pixels are each substantially square in shape;

and said apertures are each substantially square in shape.

51. An apparatus as claimed in claim 37, wherein:

each of said apertures occupies an area less than said surface area of a respective one of said detector pixels.

52. An apparatus as claimed in claim 37, further comprising:

a plurality of said radiation masks.

53. An apparatus as claimed in claim 37, wherein:

said opaque portion of said radiation mask is configured to form first walls of said radiation mask extending substantially parallel to each other along a first direction and second walls of said radiation mask extending substantially parallel to each other along a second direction.

54. An apparatus as claimed in claim 37, wherein:

said opaque portion of said radiation mask is configured to form first walls and second walls of said radiation mask extending along first and second directions, respectively, such that at least one of said first and second walls are angled to focus to a point at a distance from said radiation mask.

55. An apparatus as claimed in claim 37, wherein:

said object or objects are being irradiated with radiation having a wavelength in the x-ray or gamma ray spectrum generated by a radiation source.

56. An apparatus as claimed in claim 37, wherein:

said object or objects are emitting radiation within the x-ray or gamma ray spectrum.

57. An apparatus as claimed in claim 37, wherein:

said radiation mask is disposed on top of said detector matrix.

58. An apparatus as claimed in claim 37, wherein:

said detection surfaces of said detector pixels are each substantially rectangular in shape;

and said apertures are each substantially square in shape.

59. An apparatus as claimed in claim 37, wherein:

said detection surfaces of said detector pixels are each substantially square in shape;

and said apertures are each substantially rectangular in shape.

60. An apparatus as claimed in claim 37, wherein:

at least one of said apertures includes a material therein.

61. An apparatus as claimed in claim 60, wherein:

said material includes one of photoresist, scintillator material or a material having a low atomic number.

62. An apparatus for obtaining a digital image of an object or objects being irradiated with radiation having a wavelength in the x-ray or gamma ray spectrum generated by a radiation source, or of an object or objects emitting radiation within the x-ray or gamma ray spectrum, comprising:

a detector matrix, comprising a plurality of detector pixels, each detector pixel comprising a detection surface having a respective surface area and being adapted to generate a signal in response to an energy stimulus applied thereto; and at least one radiation mask having an opaque portion and a plurality of apertures therein, said radiation mask being positioned between the detector matrix and the object or objects, or between the radiation source and the object or objects, such that said opaque portion substantially prevents portions of said radiation from passing therethrough, and each of said apertures permits a portion of said radiation that has passed through or has been emitted from a respective portion of said object to pass therethrough and strike portions of a plurality of said detection surface of a respective plurality of said detector pixels, so that said detector pixels each output a respective signal representative of an image of said respective portion of said object.

63. A method for using a detector matrix comprising a plurality of detector pixels to obtain a digital image of an object or objects being irradiated with radiation having a wavelength in the x-ray or gamma ray spectrum generated by a radiation source, or of an object or objects emitting radiation within the x-ray or gamma ray spectrum, the method comprising the steps of:

preventing first portions of said radiation which have passed through said object or have been emitted from said object from propagating onto any of said detector pixels; and permitting second portions of said radiation which have passed through or have been emitted from respective portions of said object to each propagate onto portions of plurality of detection surfaces of a respective plurality of said detector pixels, so that said detector pixels each output a respective signal representative of an image of said respective portion of said object.

64. A method for using a detector matrix comprising a plurality of detector pixels to obtain a digital image of an object or objects being irradiated with radiation having a wavelength in the x-ray or gamma ray spectrum generated by a radiation source, or of an object or objects emitting radiation within the x-ray or gamma ray spectrum, the method comprising the steps of:

preventing first portions of said radiation which have passed through said object or have been emitted from said object from propagating onto any of said detector pixels; and permitting second portions of said radiation which have passed through or have been emitted from respective portions of said object to each propagate onto at least a portion of a detection surface of at least a respective one of said detector pixels, so that said detector pixels each output a respective signal representative of an image of said respective portion of said object; wherein:

said detector pixels are arranged in said detector matrix in a plurality of detector rows, each comprising a first number of said detector pixels, and a plurality of detector columns, each comprising a second number of said detector pixels, said detector pixels in each of said detector rows being separated by a first pixel pitch distance, and said detector pixels in each of said detector columns being separated by a second pixel pitch distance; and a radiation mask is disposed between said radiation source and said object, or between said object and said detector matrix, and includes apertures that are arranged in a plurality of aperture rows, each comprising a first number of apertures, and a plurality of aperture columns, each comprising a second number of said apertures; and wherein said method further comprises at least one of the following steps:

after performing said preventing and permitting steps, performing a first step of moving said detector matrix and said radiation mask in synchronism in relation to said object by a first distance equal to a fraction of said first pixel pitch distance in a first direction substantially parallel to said detector rows, and repeating said preventing and permitting steps to enable said areas of said detection surfaces of said detector pixels to receive portions of said radiation propagating through or emitted from other portions of said object and to output signals representative of said other portions; and after performing said preventing and permitting steps, performing a second step of moving said detector matrix and said radiation mask in synchronism in relation to said object by a second distance equal to a fraction of said second pixel pitch distance in a second direction substantially parallel to said detector rows, and repeating said preventing and permitting steps to enable said areas of said detection surfaces of said detector pixels to receive portions of said radiation propagating through or emitted from other portions of said object and to output signals representative of said other portions.

65. A method as claimed in claim 64, wherein:

said second step is performed after said first step has been performed.

66. A method as claimed in claim 64, wherein:

said second step is performed before said first step has been performed.

67. A method as claimed in claim 64, wherein:

during said first step, said detector matrix and said radiation mask are moved in synchronism incrementally in said first direction, and said preventing and permitting steps are repeated after each incremental movement, until said detector matrix and said radiation mask have moved said first distance; and during said second step, said detector matrix and said radiation mask are moved in synchronism incrementally in said second direction, and said preventing and permitting steps are repeated after each incremental movement, until said detector matrix and said radiation mask have moved said second distance.

68. A method as claimed in claim 67, wherein:

said first and second steps are repeated until said detector pixels have output signals representative of an entirety of said object.

69. A method for using a detector matrix comprising a plurality of detector pixels to obtain a digital image of an object or objects being irradiated with radiation having a wavelength in the x-ray or gamma ray spectrum generated by a radiation source, or of an object or objects emitting radiation within the x-ray or gamma ray spectrum, the method comprising:

positioning at least one radiation mask having an opaque portion and a plurality of apertures therein between said object or objects and said detector matrix, so that said opaque portion of said radiation mask prevents first portions of said radiation which have passed through said object or have been emitted from said object from propagating onto any of said detector pixels, and said apertures of said radiation mask permit second portions of said radiation which have passed through or have been emitted from respective portions of said object to each propagate onto a portion of a detection surface of a respective one of said detector pixels, said portion being less than the entire said detection surface of said respective one said detector pixel, so that said detector pixels each output a respective signal representative of an image of said respective portion of said object having a resolution based on a size of a respective one of said apertures.

70. A method as claimed in claim 69, wherein:

said apertures permit said second portions of said radiation to each propagate onto an area of said detection surface, less than said surface area, of a respective one of said detector pixels.

71. A method as claimed in claim 69, wherein:

said apertures permit said second portions of said radiation to strike portions of a plurality of said detection surfaces of a respective plurality of said detector pixels.

72. A method as claimed in claim 69, further comprising the step of:

arranging said images of said respective portions of said object to form the digital image of said object.

73. A method as claimed in claim 69, further comprising the steps of:

after performing said positioning steps, moving said detector matrix and radiation mask in relation to said object; and after performing said moving step, allowing said areas of said detection surfaces of said detector pixels to receive portions of said radiation propagating through or emitted from other portions of said object and to output signals representative of said other portions.

74. A method as claimed in claim 69, wherein:

said detector pixels are arranged in said detector matrix in a plurality of detector rows, each comprising a first number of said detector pixels, and a plurality of detector columns, each comprising a second number of said detector pixels, said detector pixels in each of said detector rows being separated by said first pixel pitch distance, and said detector pixels in each of said detector columns being separated by said second pixel pitch distance; and said apertures in said radiation mask are arranged in a plurality of aperture rows, each comprising a first number of apertures, and a plurality of aperture columns, each comprising a second number of said apertures; and wherein said method further comprises at least one of the following steps:

after performing said positioning step, performing a first step of moving said detector matrix and said detector mask in relation to said object by a first distance equal to a fraction of said first pixel pitch distance in a first direction substantially parallel to said detector rows, and allowing said areas of said detection surfaces of said detector pixels to receive portions of said radiation propagating through or emitted from other portions of said object and to output signals representative of said other portions; and performing a second step of moving said detector matrix and said detector mask in relation to said object by a second distance equal to a fraction of said second pixel pitch distance in a second direction substantially parallel to said detector rows, and repeating said positioning to enable said areas of said detection surfaces of said detector pixels to receive portions of said radiation propagating through or emitted from further other portions of said object and to output signals representative of said further other portions.

75. A method as claimed in claim 74, wherein:

said second step is performed after said first step has been performed.

76. A method as claimed in claim 74, wherein:

said second step is performed before said first step has been performed.

77. A method as claimed in claim 74, wherein:

during said first step, said detector matrix and said radiation mask are moved incrementally in said first direction, until said detector matrix and said radiation mask have moved said first distance; and during said second step, said detector matrix and said radiation mask are moved incrementally in said second direction, until said detector matrix and said radiation mask have moved said second distance.

78. A method as claimed in claim 74, wherein:

said first and second steps are repeated until said detector pixels have output signals representative of an entirety of said object.

79. A method as claimed in claim 69, further comprising the steps of:

after performing said positioning step, moving said radiation source in relation to said object; and after performing said moving step, allowing said areas of said detection surfaces of said detector pixels to receive portions of said radiation propagating through or emitted from other portions of said object and to output signals representative of said other portions.

80. A method as claimed in claim 69, wherein:

said radiation mask focuses said second portions of said radiation toward said detector pixels.

81. A method as claimed in claim 69, wherein:

said radiation mask permits said second portions of said radiation to propagate unfocused toward said detector pixels.

82. A method as claimed in claim 69, wherein:

said object or objects are being irradiated with radiation having a wavelength in the x-ray or gamma ray spectrum generated by a radiation source.

83. A method as claimed in claim 69, wherein:

said object or objects are emitting radiation within the x-ray or gamma ray spectrum.

84. A method as claimed in claim 69, wherein:

said positioning step includes placing said radiation mask on top of said detector matrix.

* * * * *